US005949310A

United States Patent [19]

Matsumoto et al.

[11] Patent Number: 5,949,310

[45] **Date of Patent: *Sep. 7, 1999**

[54] DIELECTRIC FILTER HAVING A PATTERN ELECTRODE DISPOSED WITHIN A DIELECTRIC BODY AND MANUFACTURING METHOD THEREOF

[75] Inventors: Haruo Matsumoto; Tadahiro Yorita; Yasuo Yamada; Hideyuki Kato; Yukihiro Kitaichi; Hisashi Mori; Tatsuya Tsujiguchi, all of Nagaokakyo, Japan

[73] Assignee: Murata Manufacturing Co., Ltd., Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/869,042

[22] Filed: Jun. 4, 1997

Related U.S. Application Data

[63] Continuation of application No. 08/719,335, Sep. 25, 1996, abandoned, which is a continuation-in-part of application No. 08/572,154, Dec. 8, 1995, abandoned, which is a continuation-in-part of application No. 08/349,461, Dec. 5, 1994, abandoned, which is a continuation-in-part of application No. 08/008,903, Jan. 25, 1993, abandoned.

[30] Foreign Application Priority Data

| | | | |
|---|---|---|---|
| Jan. 23, 1992 | [JP] | Japan | 4-010009 |
| Mar. 9, 1992 | [JP] | Japan | 4-021392 U |
| Mar. 16, 1992 | [JP] | Japan | 4-057894 |
| Apr. 28, 1992 | [JP] | Japan | 4-035632 U |

[51] Int. Cl.[6] ..... H01P 1/205

[52] U.S. Cl. ..... 333/202; 333/206

[58] Field of Search ..... 333/202, 206, 333/207, 222, 223, 204, 203

[56] References Cited

U.S. PATENT DOCUMENTS

| | | | |
|---|---|---|---|
| 5,130,683 | 7/1992 | Agahi-Kesheh et al. | 333/203 |
| 5,157,365 | 10/1992 | Hoang | 333/206 |
| 5,293,141 | 3/1994 | Kobayashi et al. | 333/206 |
| 5,344,695 | 9/1994 | Hirai et al. | 333/206 X |
| 5,572,174 | 11/1996 | Kitaichi et al. | 333/222 X |

FOREIGN PATENT DOCUMENTS

| | | | |
|---|---|---|---|
| 0438149 | 7/1991 | European Pat. Off. . | |
| 0442418 | 8/1991 | European Pat. Off. . | |
| 0444948 | 9/1991 | European Pat. Off. . | |
| 0448085 | 9/1991 | European Pat. Off. . | |
| 62-30402 | 2/1987 | Japan | 333/204 |
| 62-40802 | 2/1987 | Japan . | |
| 62-183603 | 8/1987 | Japan . | |

OTHER PUBLICATIONS

Patent Abstracts of Japan, vol. 13, No. 292 (E–782) (3640) Jul. 6, 1989; JP–A–10 73 802 (Matsushita Electric Works Ltd.) Mar. 20, 1989.

*Primary Examiner*—Seungsook Ham

*Attorney, Agent, or Firm*—Ostrolenk, Faber, Gerb & Soffen, LLP

[57] ABSTRACT

Grooves are formed on the connection faces of two dielectric base plates in a dielectric resonator. Internal conductors are provided on the inside faces. Coupling electrodes are formed on another dielectric base plate. These three dielectric base plates are connected so that the coupling electrode effects a capacity connection between the internal conductors. This arrangement permits an earth electrode (e.g., an external conductor) to be formed on almost the full exterior of the dielectric resonator, thereby preventing the reduction of the Qo of the resonator and electromagnetic field leakage.

12 Claims, 37 Drawing Sheets

DIELECTRIC FILTER HAVING A PATTERN ELECTRODE DISPOSED WITHIN A DIELECTRIC BODY AND MANUFACTURING METHOD THEREOF

This is a Continuation of application Ser. No. 08/719,335, filed on Sep. 25, 1996, abandoned, which is a continuation of application Ser. No. 08/572,154, filed on Dec. 8, 1995, abandoned, which is a continuation of application Ser. No. 08/349,461, filed on Dec. 5, 1994, abandoned, which is a continuation of application Ser. No. 08/008,903, filed on Jan. 25, 1993, abandoned.

BACKGROUND OF THE INVENTION

The present invention generally relates to a dielectric resonator with an earth electrode and a resonance electrode being formed on a dielectric base plate or a dielectric block, and a manufacturing method thereof.

A dielectric resonator having resonance electrodes (internal conductors) formed within a dielectric block, and earth electrodes (external conductors) formed on the outside face of a dielectric block is known. Also known is a dielectric resonator having resonance electrodes (strip lines) formed on one surface of a dielectric base plate and earth electrodes formed on an opposite surface. Such resonators are used as filters and so on in, for example, microwave bands.

Coils for connecting resonators, capacitors and base plates and so on for mounting them, together with a plurality of dielectric resonators, capacitors and base plates and so on are accommodated within a case in a dielectric filter of a discrete type which includes, for example, a plurality of dielectric resonators.

Various types of dielectric resonators, coils and capacitors are used in accordance with the required specifications in the dielectric filters of such construction.

In an integrated type of dielectric filter, a plurality of resonators are constructed on a dielectric block which is integral from the beginning, or which is integrated by the assembling operation, and correspond to a plurality of stages of dielectric filters and so on.

A transmission filter and a reception filter are used in a transceiver sharing device in, for example, the microwave band. Characteristics such as a smaller damping amount in the transmission band and yet a sufficiently large damping amount in the transmission band are required in the reception filters. It is effective to provide a pole (hereinafter referred to as polarization) as an effective method in the designing of a band pass filter capable of having a given damping amount in a frequency zone generally away from the pass band width.

In the dielectric filter of the conventional construction, it is not suitable for a dielectric filter to be of a type which mounts on the surface of, for example, a basic plate, because the terminal for coupling use has to be inserted from the outside into the resonance electrode formed hole so as to interconnect the resonators of the given stages. Also, special parts are required for the operation is in order to directly effect the electromagnetic connection among its front, rear resonators with the resonator of one or more stages being bypassed.

A dielectric resonator of a surface mounting type as shown in FIG. 65 and FIG. 66 is taken into consideration in connection with the present application and has been disclosed in Japanese Patent Laid-Open Publication No. 3-303366.

FIG. 65 is a perspective view of a dielectric resonator. FIG. 66 is a top face view of the dielectric resonator. In FIG. 65, reference numerals 102, 103 are respectively dielectric base plates. Sectional semi-circular shaped grooves 105, 106, 107, 108, 109 are provided respectively on a first main face (a face opposite to the dielectric base plate 103) of the dielectric base plate 102 and the first main face (a face opposite to the dielectric base plate 102) of the dielectric base plate 103, with internal conductors being respectively formed on the inside faces thereof. Signal input, output electrodes (115 and so on) are formed across the second main face (bottom face in the drawing) from two side faces of the dielectric base plates 103. Coupling electrodes E10 are formed on a given region of the second main face (top face in the drawing) of the dielectric base plate 102. An external conductor 112 is formed on the external surfaces of the dielectric base plates 102, 103 except for the regions of the above described signal input, output electrodes (115 and so on) and the coupling electrodes E10. As shown in FIG. 66, the coupling electrodes E10 effect the respective capacity connection between the open end vicinity of the internal conductors 117, 119 within the internal formed holes 106, 108. By such construction, the second stage and the fourth stage among the band pass filters of five stages are interconnected so as to cause the damping pole on the low-pass side of the pass band width.

The dielectric resonators shown in FIG. 65 and FIG. 66 can be provided with poles without addition of special parts, with a large operational advantage, in that the surface mounting operation can be effected on the circuit base plate together with the electronic parts of the other surface mounting type. However, in such conventional dielectric filter as shown in FIG. 65 and FIG. 66, the Qo value of the resonator is lower, thus resulting in a danger of deteriorating the insertion loss characteristics of the filter, because the current flowing through the external conductor 112 is interrupted in the region where the coupling electrode E10 is formed. As the coupling electrode formed region becomes an open portion of the external conductor, some electromagnetic field leakage is caused, so that the influence of a metallic unit adjacent to the dielectric filter may become a problem.

In a dielectric filter of the conventional discrete type, individual parts such as coils, capacitors or the like are required together with a plurality of dielectric resonators, with a defect that the whole becomes larger in size as the number of the parts increases, and the assembling operation step is complicated. In the conventional integral type of dielectric filter, only the filter of the characteristics restricted is provided in the pattern formation of the resonance electrode or the earth electrode although the above described defects are not provided. When the plan circuit and so on are constructed with one portion of the earth electrode (external conductors) being patterned, some measures are required to be taken with respect to the electromagnetic leakage.

Also, in the conventional dielectric filter, there is danger of lowering the Qo value of the resonator, deteriorating the insertion loss characteristics of the filter, because the current flowing through the external conductor is interrupted in the region of the coupling electrode. As the coupling electrode region is an opening portion of the external conductor, there is danger of causing some electromagnetic leakage, which causes a problem of influence by the metallic unit adjacent to the dielectric filter.

In the conventional dielectric filter, the respective base plate, capacitor element and coil parts are necessary and further, a soldering operation for engaging the respective parts is required, which causes the problems that the cost rises and also, the productivity is lower.

Further, since the pole-providing electrode is formed within the region of the earth electrode with one portion of the earth electrode of the dielectric base plate being shaved off to form the conventional polarized construction, the earth current flowing through the above described earth electrode is interrupted in the above described gap portion, which causes a problem that the Qo value of the resonance electrode is deteriorated, and the characteristics of insertion loss are lowered.

SUMMARY OF THE INVENTION

Accordingly, a primary object of the present invention is to provide a dielectric resonator which basically assumes the construction of an integral type dielectric resonator and is smaller in size and can easily obtain specific given characteristics.

Another object of the present invention is to provide a dielectric resonator which is capable of effecting polarization without addition of special parts.

Still another object of the present invention is to provide a dielectric resonator which is suitable for use in a polarized dielectric filter superior in the insertion loss characteristic without loss of Qo value of the resonator;

A further object of the present invention is to provide a dielectric filter which has a reduced number of parts and a reduced cost, and can improve productivity by omitting manufacturing steps.

A still further object of the present invention is to provide a dielectric filter which can avoid the deterioration of the Qo value, when the pole-providing electrode is added, to improve the insertion loss.

A dielectric resonator of a first embodiment of the invention is composed of additional electrode layers within the above described dielectric in a dielectric resonator where a plurality of resonance electrodes are arranged, and a dielectric is interposed between the resonance electrodes and the additional electrodes.

In the dielectric of the first embodiment of the invention, a plurality of resonance electrodes and earth electrodes are formed, separated by dielectrics and also, additional electrode layers are provided within the dielectric. The additional electrode layers function as electrodes to be connected with, for example, the resonance electrodes, electrodes for constituting inductor, capacitor, line and so on or a plan circuit including them, and constitute various types of filters and so on such as BPF, BEF, LPF, HPF or the like together with a plurality of resonators.

A dielectric resonator in accordance with a second embodiment of the invention has a coupling electrode layer provided for effecting capacity connection with a plurality of resonance electrodes within the above described dielectric, in a dielectric resonator where a plurality of resonance electrodes are arranged, dielectrics are interposed among these resonance electrodes and the earth electrodes.

In the dielectric resonator of a second invention, plurality of resonance electrodes and earth electrodes are formed through dielectrics, and also, coupling electric layers are provided within the dielectric. The coupling electrode layer is connected by capacity with a plurality of resonance electrodes. In a band pass filter of, for example, three stages or more, a damping pole is formed on the high-pass side of the pass band by the capacity connection through a coupling electrode layer between first, second stages of resonance electrodes. If the capacity connection is effected through the coupling electrode layer between the resonance electrodes of second and fourth stages of resonance electrodes among, for example, five stages of band passing filter, a damping pole is formed on the low-pass side of the pass band.

The additional electrode layer is provided within the dielectric. The coupling electrode is not required to be provided within the earth electrode formed region. Current flowing through the earth electrodes is not interrupted. The Qo value is not lowered. The filter can be used as a dielectric filter of less insertion loss.

A third embodiment of the invention is a dielectric filter characterized in that an earth electrode is formed on the other main face of the dielectric base plate, a plurality of resonance electrodes are formed on one main face, and one side face of the resonance electrode is connected with the above described earth electrode so as to have a coupling electrode, a stray electrode and a coil electrode pattern-formed within the above described dielectric basic plate.

In order to form the respective electrodes within the above described dielectric base plate, the portion facing the resonance electrode of the dielectric base plate is cut into two divisions, and the respective electrodes are formed in pattern by, for example, a screen printing method on one of the divided cut faces so as to stick to both of them.

When the resonance electrode is formed on the above described dielectric base plate, both are connected with each other if adjacent resonance electrodes are brought too close, so that the desired characteristics may be not be obtained. In order to avoid the connection of the resonance electrodes, a removing operation can be effected by the interval between the resonance electrodes. The size of the dielectric base plate becomes larger correspondingly by the interval of both the electrodes, thus causing a disadvantage that the whole part becomes larger in size.

According to the dielectric filter of the third embodiment of the invention, the coupling electrode, the stray electrode and the coil electrode are formed in pattern within the dielectric base plate, and the respective electrodes can be formed at the same time. The number of the parts can be reduced as compared with a case where a base plate is disposed on the conventional dielectric coaxial resonator, the parts such as capacitor element, coil and so on are connected with the base plate, and the cost can be lowered, thus improving productivity.

A fourth embodiment of the invention is characterized in that the shielding electrode is formed between the adjacent resonance electrodes on one main face of the above described dielectric base plate, and both the ends of the shielding electrode are connected with the above described earth electrodes.

In the fourth embodiment of the invention, the shielding electrode connected with the earth electrode is formed between the resonance electrodes of the above described dielectric base plate. As the electric force lines to be emitted from both the above described resonance electrodes are absorbed by the shielding electrodes, the intervals between the resonance electrodes can be narrowed without deterioration in the characteristics, and the dielectric base plate can be made correspondingly smaller in size.

A fifth embodiment of the invention is characterized in that the above described polarized electrode is formed within the above described dielectric base plate, in the pole-providing construction of a dielectric filter where a plurality of resonance electrodes are formed on one main face of the dielectric base plate, and an earth electrode is formed on the other main face, one side face of the above described resonance electrode is connected with the earth electrode, a pole-providing electrode for connecting by capacity the above described resonance electrode with the above described dielectric base plate is formed.

In order to form the pole-providing electrode within the above described dielectric base plate, a portion facing the resonance electrode of the above described dielectric base plate is cut so as to have the base plate formed into two divisions, the pole-providing electrode is formed on the cut face of one side of the divided form so as to stick to both of them.

According to the dielectric filter of the fifth embodiment of the invention, the pole-providing electrode is formed within the dielectric base plate. As the earth electrode can be formed on the full face of the other main face of the dielectric base plate, the obstruction of the electric current in the formation of the pole-providing electrode by shaving the conventional earth electrode can be removed. As a result, the reduction in the insertion loss can be improved by the avoidance of the deterioration in the Qo value, thus improving the electric characteristics.

A method of manufacturing a dielectric resonator of a sixth embodiment of the invention comprises the steps of connecting a dielectric base plate with a plurality of resonance electrode films being formed on it with a plurality of base plates including a dielectric base plate with additional electrode films being formed on it, manufacturing a dielectric resonator having the additional electrode layers within the dielectric.

In a method of manufacturing the dielectric resonator of the sixth embodiment of the invention, the dielectric resonator having the additional electrode layers within the dielectric is manufactured by the connection of a dielectric base plate with a plurality of resonance electrode films being formed on it with a plurality of base plates including dielectric base plate with additional electrode films being formed on it.

Therefore, the additional electrode layers to be provided within the dielectric has only to be formed in advance on the dielectric base surface.

A method of manufacturing a dielectric resonator of a seventh embodiment of the invention comprises the steps of connecting a dielectric base plate with a plurality of resonance electrode films and additional electrode films being formed on it opposite to the these resonance electrode films, with a plurality of base plates including the other dielectric base plate, manufacturing a dielectric resonator having additional electrode layers in the dielectric interior.

In a method of manufacturing the dielectric resonator of the seventh embodiment of the invention, a plurality of resonance electrode films and additional electrode films opposite to these resonance electrode films are formed on a certain one dielectric base plate, and the other base plate is connected on the base plate.

A method of manufacturing a dielectric resonator of an eighth embodiment of the invention comprises the steps of composing a dielectric unit having a plurality of resonance electrode films formed therein, connecting a dielectric base plate with the additional electrode films being formed on it with the above described dielectric unit, manufacturing a dielectric resonator having additional electrode layers within the dielectric.

In a method of manufacturing the dielectric resonator of the eighth embodiment of the invention, the dielectric base plate with additional electrode films being formed on it is connected with respect to the dielectric unit with a plurality of resonance electrode dielectric films being formed therein. In this case, the dielectric unit constitutes a plurality of dielectric resonators, and a plane circuit is added with respect to a plurality of dielectric resonators by the connection the dielectric base plates having the additional electrode films.

A method of manufacturing a dielectric resonator of a ninth embodiment of the invention comprises the steps of using a dielectric ceramic green sheet with a plurality of resonance electrode films being formed on it, a dielectric ceramic green sheet with additional electrode films being formed on it, effecting an integral laminated confirming operation, manufacturing a dielectric resonator having additional electrode layers within the dielectric.

In the method of manufacturing the dielectric resonator of the ninth embodiment of the invention, the dielectric ceramic green sheet with a plurality of resonance electrode films being formed on it, the dielectric ceramic green sheet with additional electrode films being formed on it are cofired integrally in lamination. Therefore, the additional electrode films are formed on the dielectric ceramic green sheet in this case, and the additional electrode layers are constructed within the dielectric by the subsequent integral cofiring operation.

A method of manufacturing a dielectric resonator of a tenth embodiment of the invention comprises the steps of connecting a dielectric base plate with a plurality of resonance electrode films being formed on it with a plurality of base plates including a dielectric base plate with a coupling electrode film being formed on it, manufacturing a dielectric resonator having coupling electrode layers within the dielectric.

In a method of manufacturing a dielectric resonator of the tenth embodiment of the invention, a dielectric base plate with a plurality of resonator electrode films being formed on it is connected with a plurality of base plates including a dielectric base plate with coupling electrode films being formed on it so that a dielectric resonator having coupling electrode layers within the dielectric is manufactured. Therefore, coupling electrode layers to be provided within the dielectric have only to be formed on the dielectric base surface in advance.

A method of manufacturing a dielectric resonator of an eleventh embodiment of the invention comprises the steps of connecting a dielectric base plate with a plurality of resonance electrode films and coupling electrode films being formed opposite to these resonance electrode films with a plurality of base plates of the other dielectric base plate, manufacturing a dielectric resonator having the coupling electrode layers within the dielectric.

In a method of manufacturing a dielectric resonator of the eleventh embodiment of the invention, a plurality of resonance electrode films and coupling electrode films opposite to these resonance electrode films are formed on a certain one dielectric base plate, and the other base plate is connected with the base plate.

A method of manufacturing a dielectric resonator of a twelfth embodiment of the invention comprises the steps of constituting a dielectric unit with a plurality of resonance electrode films therein being formed therein, connecting a dielectric base plate with coupling electrode films being formed on it with the above described dielectric unit, manufacturing a dielectric resonator having coupling electrode layers within the dielectric.

In a method of manufacturing the dielectric resonator of the twelfth embodiment of the invention, the dielectric base plate with the coupling electrode films being formed on it is connected with respect to a dielectric unit with a plurality of resonance electrode films being formed therein. it. In this case, the dielectric unit constitutes a plurality of dielectric resonators, coupling electrodes are added with respect to the plurality of dielectric resonators by the connection of the dielectric base plate having the coupling electrode films.

BRIEF DESCRIPTION OF THE DRAWINGS

These and other objects and features of the present invention will become apparent from the following description of preferred embodiments thereof with reference to the accompanying drawings, in which.

DETAILED DESCRIPTION OF EMBODIMENTS OF THE INVENTION

Figure 1:
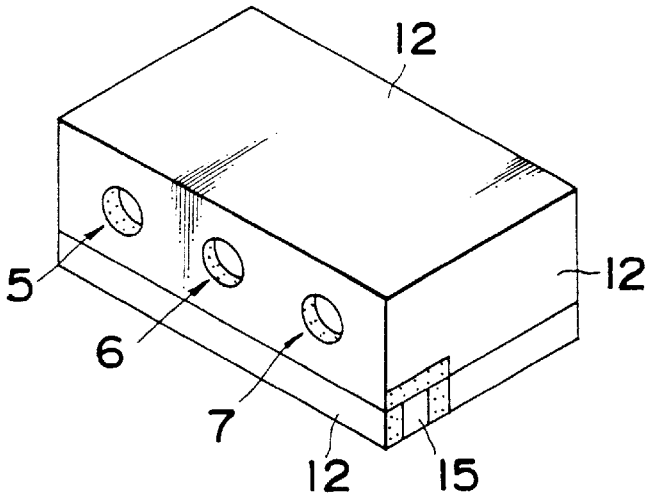
FIG. 1 is a perspective view of a dielectric filter in accordance with a first embodiment.

Before the description of the present invention proceeds, it is to be noted that like parts are designated by like reference numerals throughout the accompanying drawings.

(First Embodiment)

The construction of a three-stage band stopping filter in accordance with a first embodiment of the present invention will be described in FIG. 1 through FIG. 4.

Figure 2:
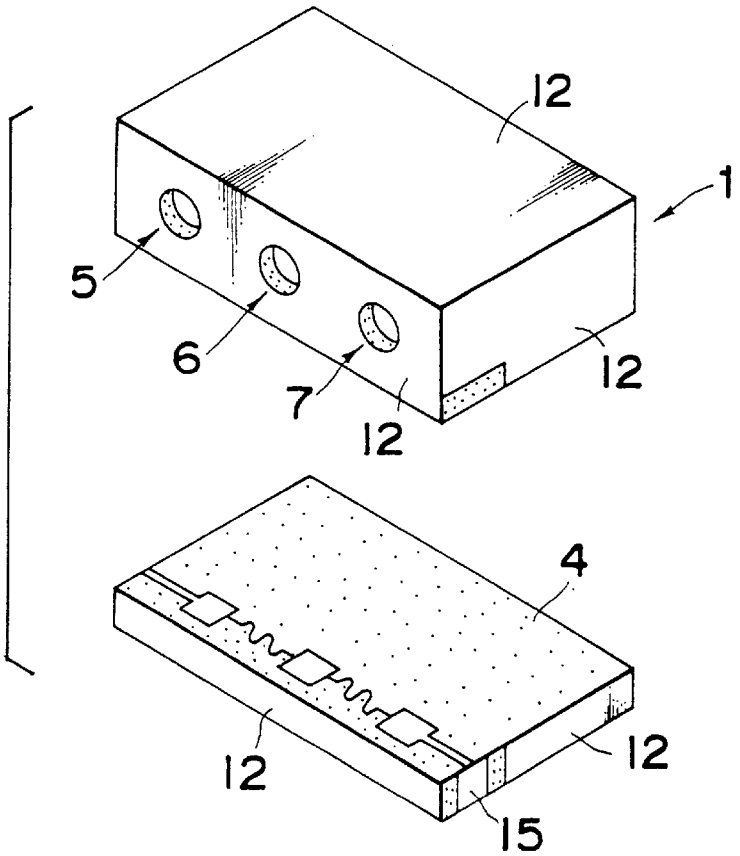
FIG. 2 is an exploded perspective view before the assembling operation of a dielectric filter in accordance with the first embodiment.

FIG. 1 is a perspective view of a filter, and FIG. 2 is an exploded perspective view before the assembling operation thereof. Referring to FIG. 2, reference numeral 1 is an approximately six-face unit shaped dielectric block, and reference numeral 4 is a dielectric base plate. Internal conductor formed holes 5, 6, 7 are provided in a dielectric block 1, and internal conductors are formed on the inside faces of the internal conductor formed holes 5, 6, 7. An external conductor 12 is formed on the outside faces (five faces) except for a face opposite to the dielectric base plate 4 of the dielectric block 1. An additional electrode pattern to be described later is formed on a face opposite to the dielectric block 1 of the dielectric base plate 4. An external conductor 12 is formed on five faces except for the additional electrode formed face so as to form signal input, output electrodes (15 and so on) in one portion of the side face. A dielectric filter shown in FIG. 1 is obtained by the connection between the dielectric block 1 and the dielectric base plate shown in FIG. 2.

Figure 3:
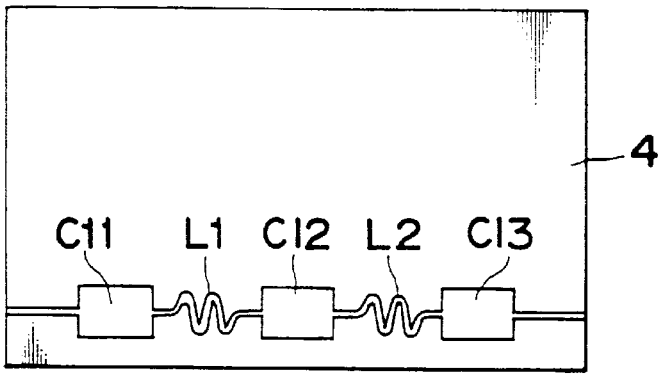
FIG. 3 is a plan view of a dielectric base plate to be used in the dielectric filter in accordance with the first embodiment.

FIG. 3 is a plan view of the dielectric base plate 4 shown in FIG. 2. In FIG. 3, reference characters C11, C12, C13 are capacitor electrodes which effect respective capacity connections with the internal conductors within the internal conductor formed holes 5, 6, 7 shown in FIG. 1 and FIG. 2 when connected with the dielectric block 1. Reference characters L1, L2 are inductor electrodes for effecting connections between the respective capacitor electrodes.

Figure 4:
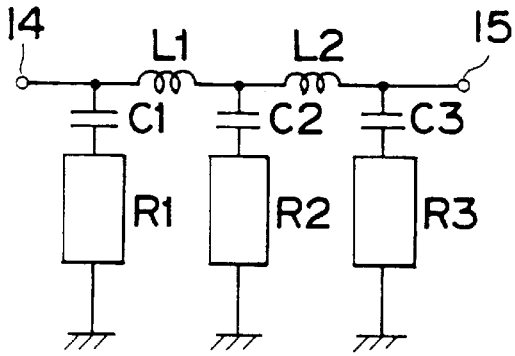
FIG. 4 is an equivalent circuit diagram of the dielectric filter in accordance with the first embodiment.

FIG. 4 shows an equivalent circuit of the dielectric filter constructed by the above described construction. In FIG. 4, reference characters R1, R2, R3 are resonators formed by the internal conductors within the internal conductor formed holes 5, 6, 7 shown in FIG. 1, and reference characters C1, C2, C3 are capacitors to be formed among the respective internal conductors with respect to the capacitor electrodes C11, C12, C13 shown in FIG. 3. Reference characters L1, L2 are inductors formed by the electrodes L1, L2 shown in FIG. 3. Reference numerals 14, 15 function in this three-stage band stopping filters as signal input, output terminals.

Similar characteristics can be obtained if additional electrodes are formed on a face opposite to the basic plate 4 of the dielectric block 1.

(Second Embodiment)

Figure 5:
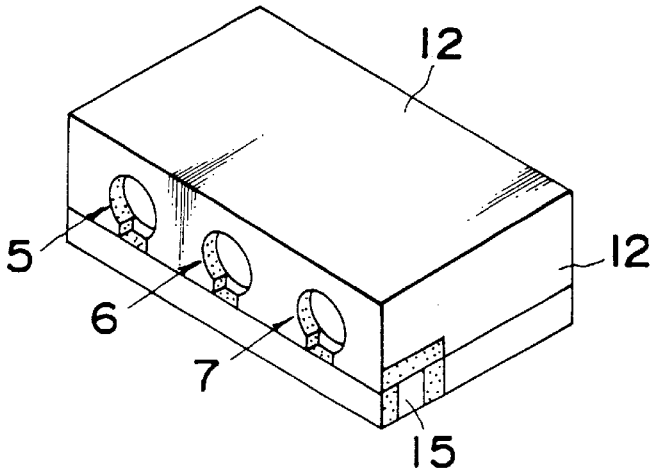
FIG. 5 is a perspective view of a dielectric filter in accordance with a second embodiment.
Figure 8:
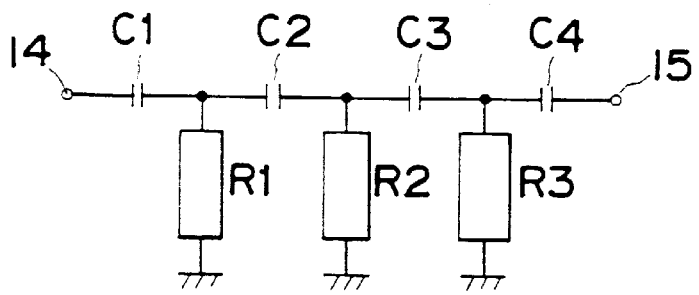
FIG. 8 is an equivalent circuit diagram of a dielectric filter in accordance with the second embodiment.

The construction of the three-stage band passing filter in accordance with the second embodiment of the present invention will be shown in FIG. 5 though FIG. 8.

Figure 6:
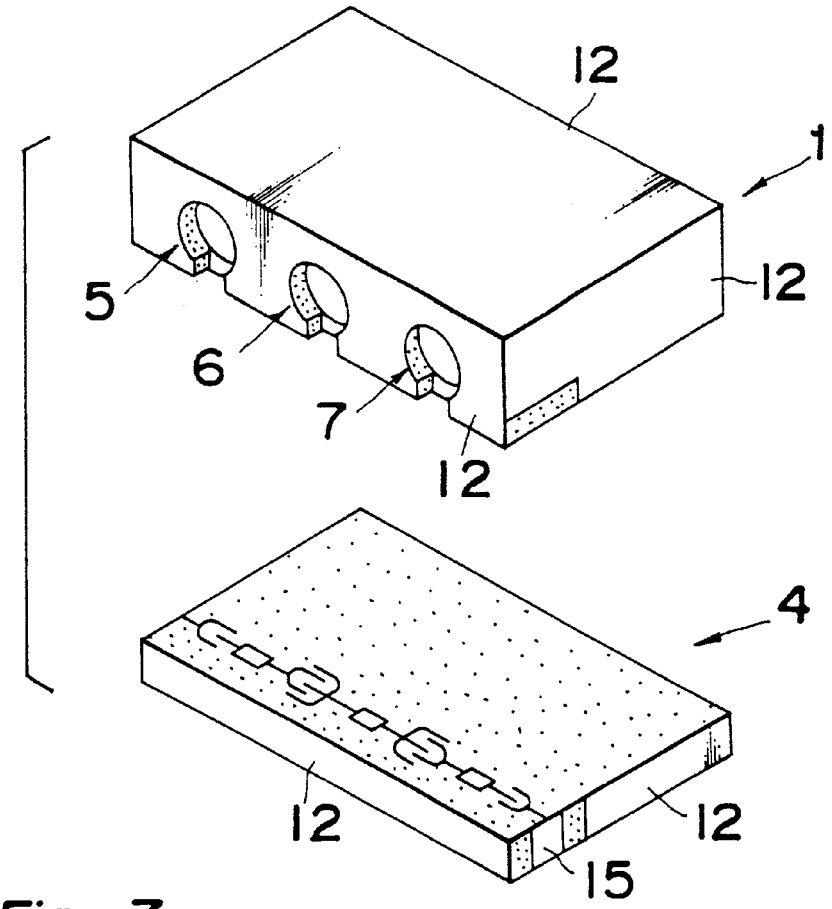
FIG. 6 is an exploded perspective view of the dielectric filter in accordance with the second embodiment.

FIG. 5 is an external appearance view. FIG. 6 is an exploded perspective view before the assembling operation. In FIG. 6, reference numeral 1 is an approximately six-face unit shaped dielectric block, and reference numeral 4 is a dielectric base plate. The internal conductor formed holes 5, 6, 7 are provided in the dielectric block 1. The internal conductors are formed on the inside faces of the internal conductor formed holes 5, 6, 7. An external conductor 12 is formed on the outside faces (five faces) except for the face opposite to the dielectric base plate 4 of the dielectric block 1. An additional electrode pattern to be described later is formed on the face opposite to the dielectric block 1 of the dielectric base plate 4. The external conductor 12 is formed on five faces except for the face with the additional electrode so as to form the signal input, output electrodes (15 and so on) on one portion of the side face. The open end portion of each internal conductor is extended so far as the bottom face portion of the dielectric block 1 in the drawing, which is different from the FIG. 1 embodiment as shown in FIG. 2. One portion of each internal conductor is constructed so as to directly connect to the additional electrode pattern. A dielectric filter shown in FIG. 5 is obtained by the connection between the dielectric block 1 and the dielectric base plate 4 shown in FIG. 6.

Figure 7:
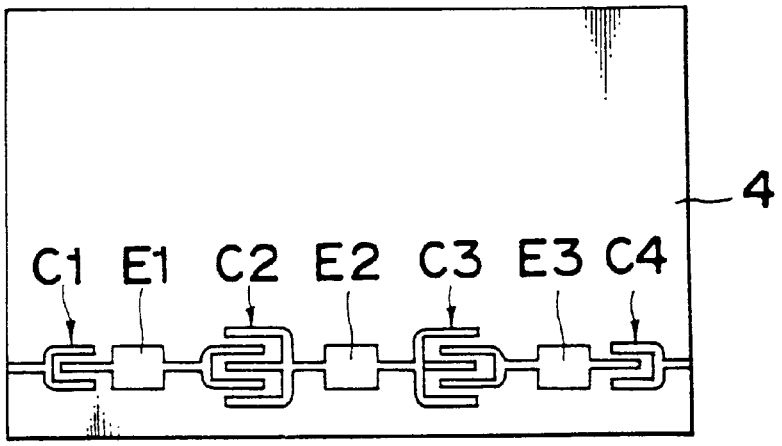
FIG. 7 is a plan view of a dielectric base plate for use in a dielectric filter in accordance with the second embodiment.

FIG. 7 is a plan view of a dielectric base plate 4 shown in FIG. 6. In FIG. 7, capacitor electrodes formed on the plane of the dielectric base plate 4 are respectively C1, C2, C3, C4, reference characters E1, E2, E3 are electrodes to be connected with the internal conductors drawn out near the open face of the internal conductor formed holes 5, 6, 7 shown in FIG. 6. The open portions of three internal conductors are respectively connected directly with the electrodes E1, E2, E3 with the dielectric block 1 being connected with the dielectric base plate 4.

FIG. 8 is an equivalent circuit diagram of a dielectric filter shown hereinabove. Referring to FIG. 8, reference characters R1, R2, R3 are resonators formed by the internal conductors within the internal conductor formed holes 5, 6, 7 shown in FIG. 5 and FIG. 6. Reference characters C1, C2, C3, C4 are capacitors formed by the electrodes C1, C2, C3, C4 shown in FIG. 7. Reference numerals 14, 15 function in this three-stage band pass filter as signal input, output terminals by the construction.

(Third Embodiment)

Figure 9:
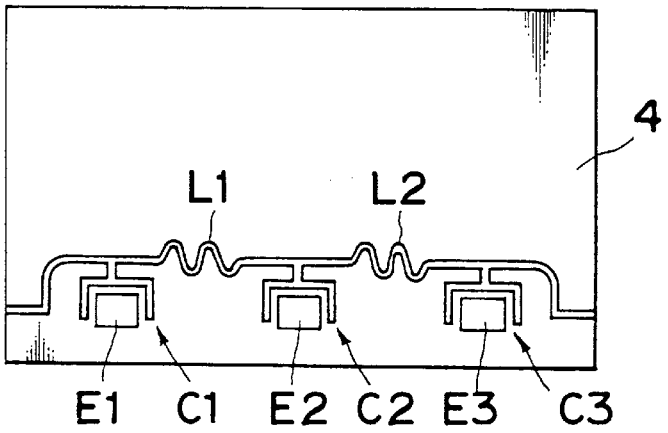
FIG. 9 is a plan view of a dielectric base plate for use in a dielectric filter in accordance with a third embodiment.

In the second embodiment, a band pass filer is constructed with the use of the dielectric block shown in FIG. 6 and the dielectric base plate shown in FIG. 7. As shown in FIG. 9, a band stopping filter can be also constructed by the use of such additional electrode pattern, which shows another dielectric base plate 4. In FIG. 9, reference characteristics E1, E2, E3 are electrodes directly connected with the open portions of the internal conductors. Reference characters C1, C2, C3 are capacitor electrodes which constitute capacitors among the electrodes E1, E2, E3. Reference characters L1, L2 are inductor electrodes. Such a three-stage band stopping filter as shown in FIG. 4 functions by the use of the dielectric base plate having such additional electrode pattern.

Examples of dielectric filters polarized by the use of the additional electrode pattern are shown as fourth through seventh embodiments.

(Fourth Embodiment)

Figure 10:
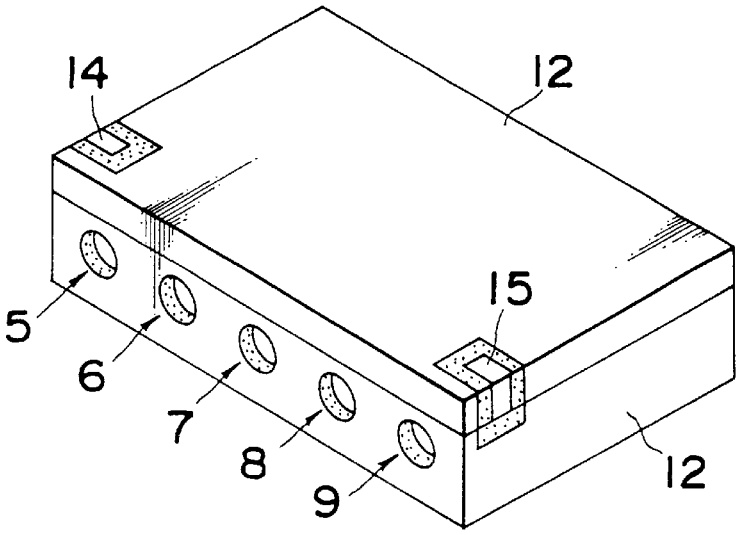
FIG. 10 is a perspective view of a dielectric filter in accordance with a fourth embodiment.
Figure 11:
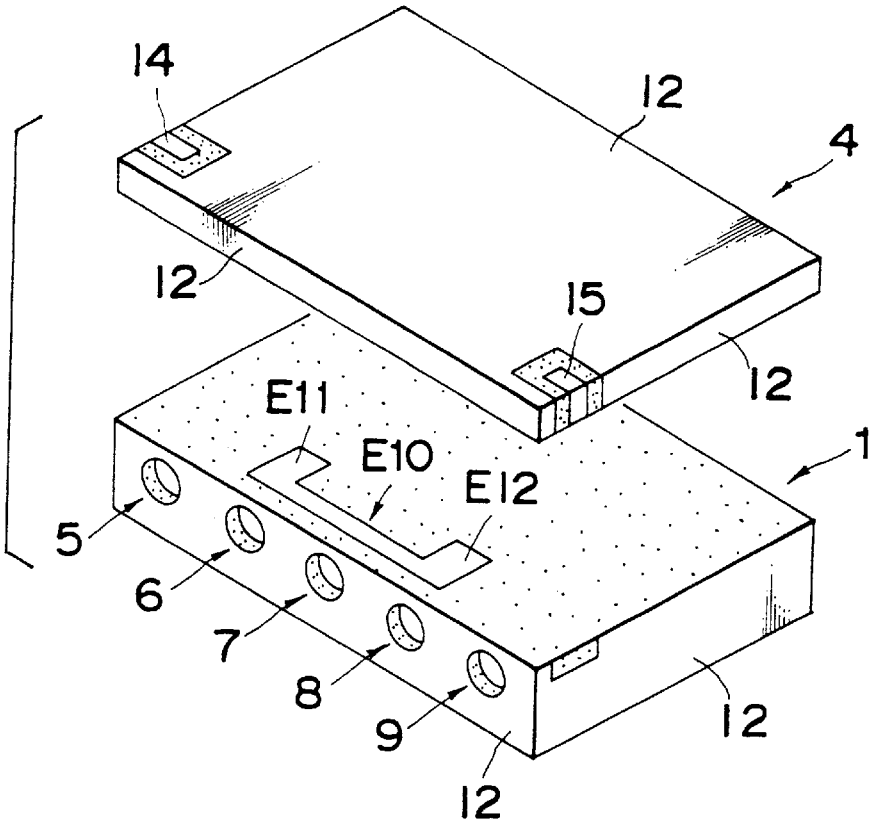
FIG. 11 is an exploded perspective view of the dielectric filter in accordance with the fourth embodiment.

FIG. 10 is a perspective view of a dielectric filter in accordance with a fourth embodiment. FIG. 11 is an exploded perspective view before the assembling operation thereof. In FIG. 11, reference numeral 1 is a dielectric block. The internal conductor formed holes 5 through 9 are provided and also, an additional electrode pattern shown at reference character E10 is formed on the connection face with the dielectric base plate. A portion shown at reference numeral E11 of the additional electrode E10 effects capacity connection with the internal conductor within the internal conductor formed hole 6, and reference character E12 effects capacity connection with the internal conductor within the internal conductor formed hole 8.

Accordingly, the internal conductors within the internal conductor formed holes 6, 8 are connected by capacity through the additional electrode E10. Tip end capacity is created at the open portion of the internal conductor within each of the internal conductor formed holes 5 through 9 so as to effect comb-line connection between the resonators. In the same drawing, reference numeral 4 is a dielectric base plate and an external conductor 12 is formed on five faces except for a face opposite to the dielectric block 1. Electrode patterns which respectively effect capacity connection with the internal conductors within the internal conductor formed holes 5, 9 are provided when the base plate is connected with the dielectric block 1 so as to drawn out these electrodes as signal input, output terminals 14, 15 onto the sides of the opposite face (the top face in the drawing). Such integral type of dielectric filter as shown in FIG. 10 is obtained by the connection between the dielectric block 1 and the dielectric base plate 4. In this case, as a second stage and a fourth stage among the five stages are connected by capacity, it functions as a band passing filter having a pole on the low-pass side.

(Fifth Embodiment)

Figure 12:
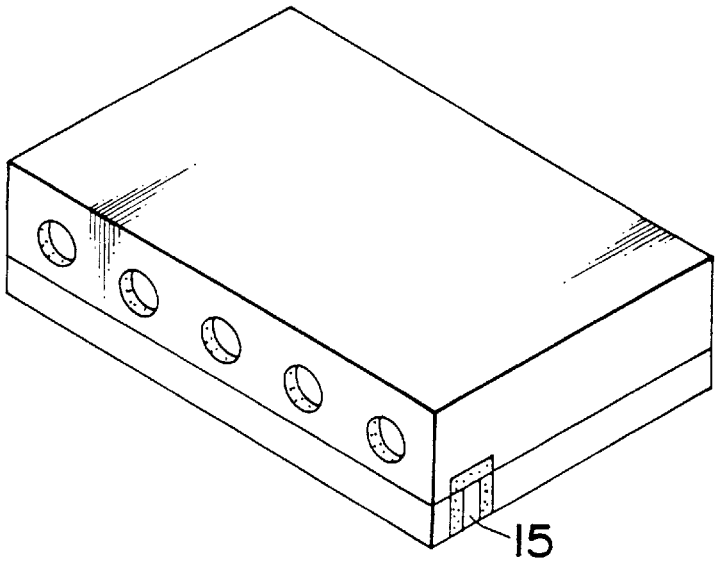
FIG. 12 is a perspective view of a dielectric filter in accordance with a fifth embodiment.
Figure 13:
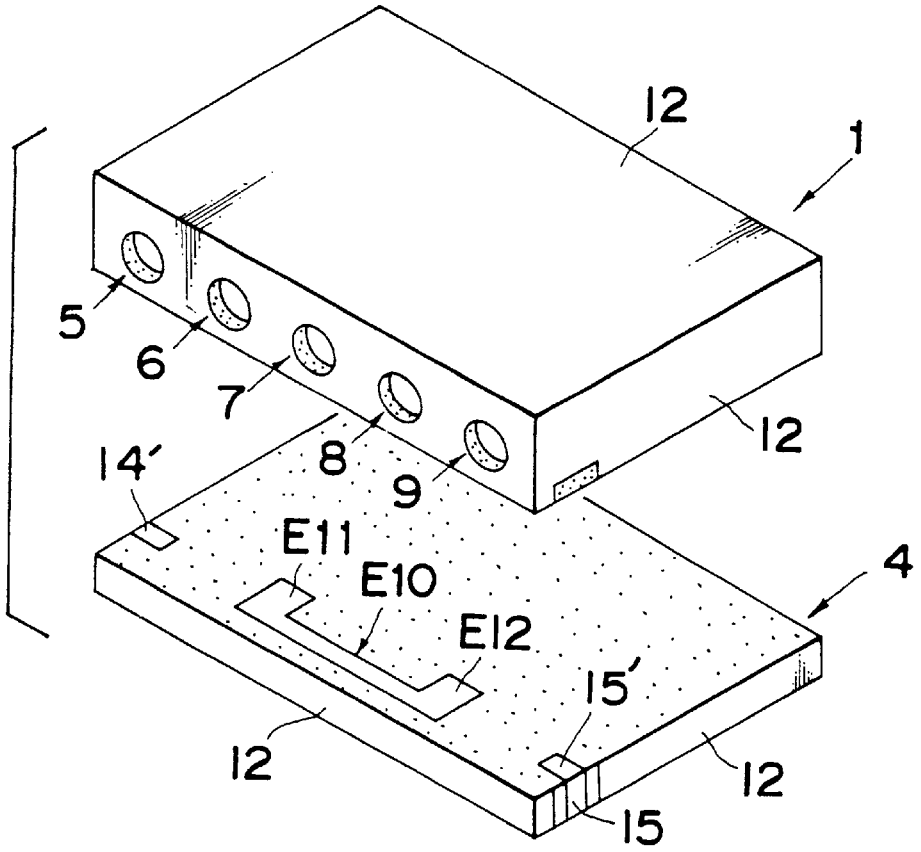
FIG. 13 is an exploded perspective view of the dielectric filter in accordance with the fifth embodiment.

FIG. 12 is a perspective view of a dielectric filter in accordance with a fifth embodiment. FIG. 13 is an exploded perspective view before the assembling operation thereof. In FIG. 13, reference numeral 1 is a dielectric block, reference numeral 4 is a dielectric base plate. A different point from the fourth embodiment shown in FIG. 10 and FIG. 11 is that the additional electrode is provided on the side of the dielectric base plate 4. In this case, the additional electrode E10 effects the capacity connection between the internal conductors within the internal conductor formed holes 6, 8, the dielectric block 1 and the dielectric base plate 4 are connected with each other. The electrodes 14', 15' respectively effect capacity connection with the internal conductors within the internal conductor formed holes 5, 9.

(Sixth Embodiment)

Figure 14:
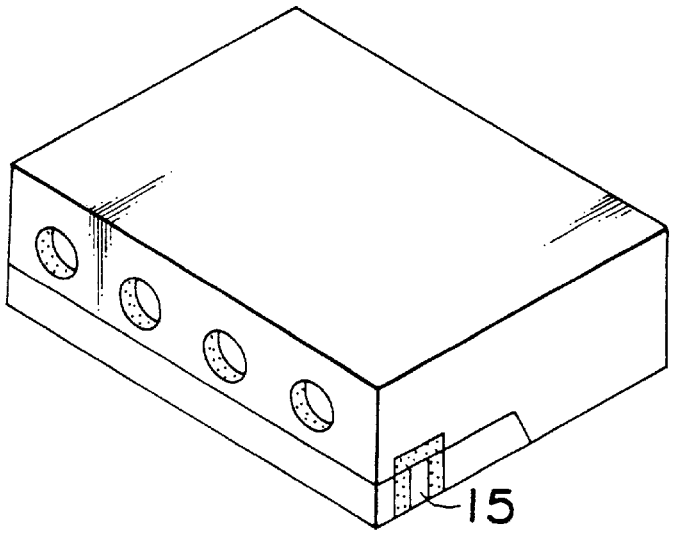
FIG. 14 is a perspective view of a dielectric filter in accordance with a sixth embodiment.
Figure 15:
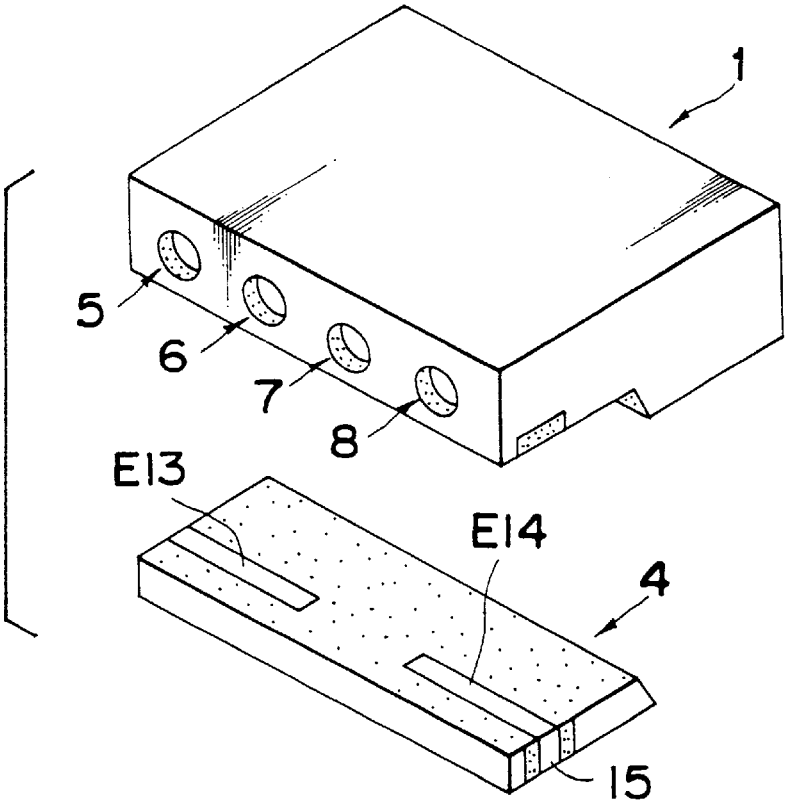
FIG. 15 is an exploded perspective view of the dielectric filter in accordance with the sixth embodiment.

FIG. 14 is a perspective view of an dielectric filter in accordance with a sixth embodiment. FIG. 15 is an exploded perspective view before the assembling operation thereof.

In FIG. 15, reference numeral 1 is a dielectric block, reference numeral 4 is a dielectric base plate. Internal conductor formed holes 5 through 8 are provided in the dielectric block 1. The additional electrodes E13, E14 are formed on the connection face with the dielectric block 1 are formed on the dielectric base plate 4. The additional electrode E13 effects capacity connection between the internal conductors within the internal conductor formed holes 5, 6 when connected with the dielectric block 1. The electrode E14 effects capacity connection between the internal conductors within the internal formed holes 7, 8. Such an integral dielectric filter as shown in FIG. 14 is obtained by the connection between the dielectric block 1 and the dielectric base plate 4. As the capacity connection is effected between a first stage and a second stage and between a third stage and a fourth stage of the four stages in this manner, a band pass filter having the pole in the high-pass region is obtained.

(Seventh Embodiment)

Figure 16:
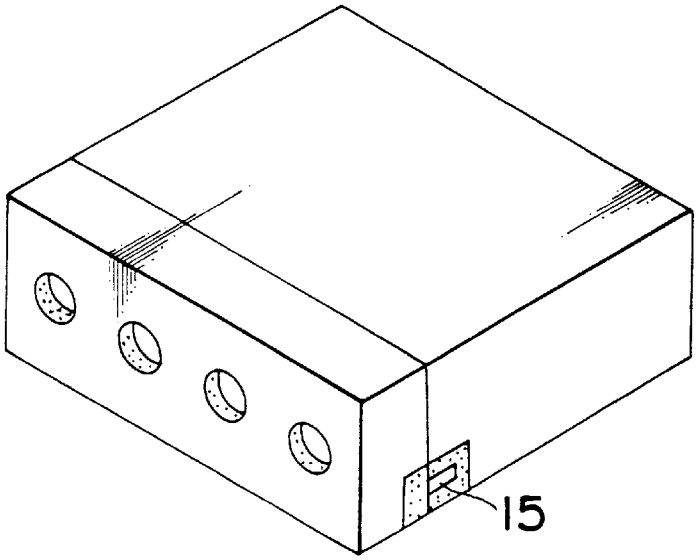
FIG. 16 is a perspective view of a dielectric filter in accordance with a seventh embodiment.
Figure 17:
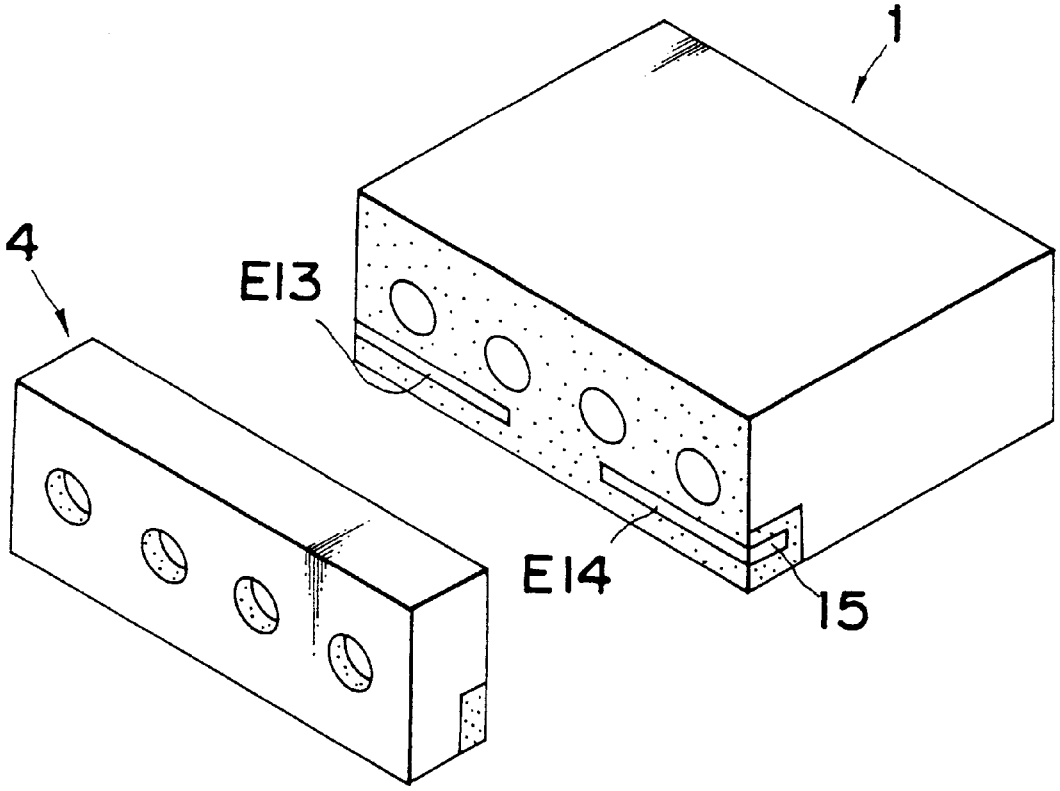
FIG. 17 is an exploded perspective view of the dielectric filter in accordance with the seventh embodiment.

FIG. 16 is a perspective view of a dielectric filter in accordance with a seventh embodiment. FIG. 17 is an exploded perspective view before the assembling operation thereof. In FIG. 17, reference numeral 1 is a dielectric block, reference numeral 4 is a dielectric base plate. The different point from the sixth embodiment shown in FIG. 14 and FIG. 15 is that the dielectric base plate 4 is adapted to effect the connection in the axial direction with respect to the dielectric block 1. The additional electrodes E13, E14 are formed on the open face side of the dielectric block 1 as shown in FIG. 17. An integral type of dielectric filter shown in FIG. 16 is obtained by the connection of the dielectric base plate 4 with the dielectric block 1.

The sixth and seventh embodiments are band pass filters. A band stopping filter can be constructed by the same construction if the pattern of the additional electrode is changed.

Examples of the dielectric filters constructed with the use of a plurality of dielectric base plates are shown as eighth through eleventh embodiments of the invention.

(Eighth Embodiment)

Figure 18:
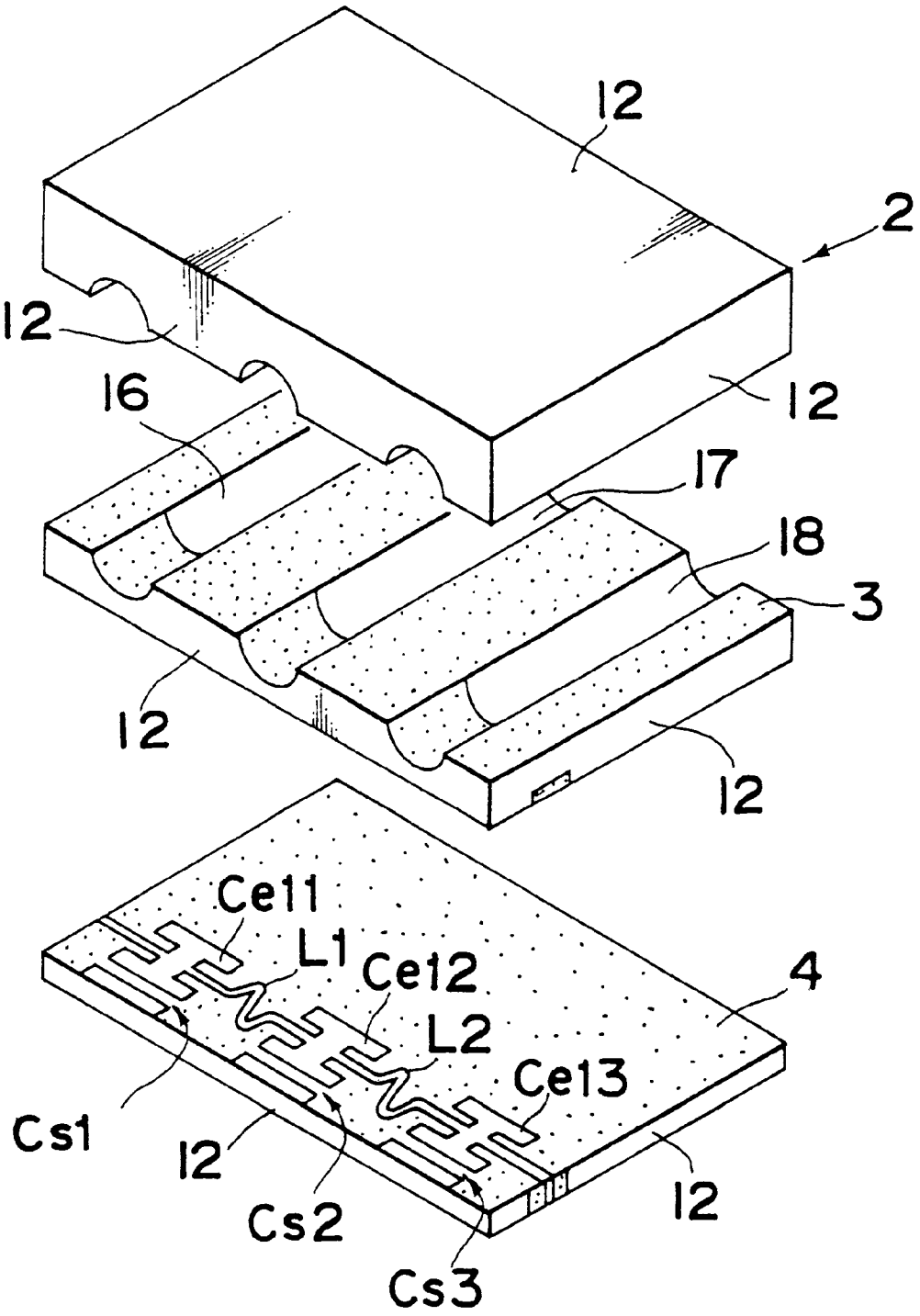
FIG. 18 is an exploded perspective view of a dielectric filter in accordance with an eighth embodiment.
Figure 19:
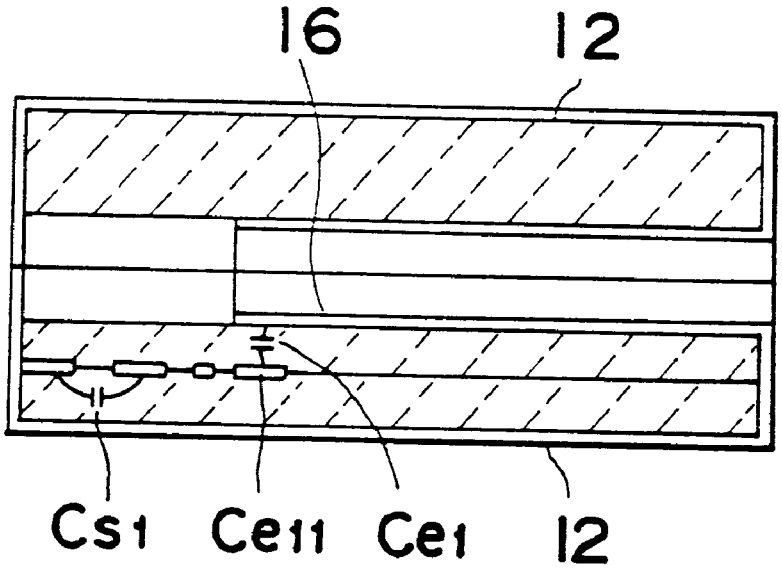
FIG. 19 is a sectional view of the dielectric filter in accordance with the eighth embodiment.

FIG. 18 is an exploded perspective view before the assembling operation of a dielectric filter in accordance with an eighth embodiment. FIG. 19 is a sectional view after the assembling operation thereof. In FIG. 18, reference numerals 2, 3, 4 are respectively dielectric base plates. The dielectric base plates 2 and 3 have respectively semi-circular cross-sectioned grooves on the opposite faces between both of them, and have internal conductors 16, 17, 18 formed on the inside faces thereof. The external conductors 12 are formed on five faces except for the face opposite to the dielectric base plate 3 of the dielectric base plate 2 and the external conductors 12 are formed on four side faces of the dielectric basic plate 3. An additional electrode is formed on the face opposite to the dielectric basic plate 3 on the dielectric basic plate 4 and the external conductors 12 are formed on five faces except for that face. In the additional electrode, reference characters Ce11, Ce12, Ce13 effect capacity connection near the open end of the internal conductors 16, 17, 18 as shown in FIG. 19 and reference characters Cs1, Cs2, Cs3 constitute respectively a capacitor between the external conductors 12. Reference numerals L1, L2 function as inductors.

Figure 20:
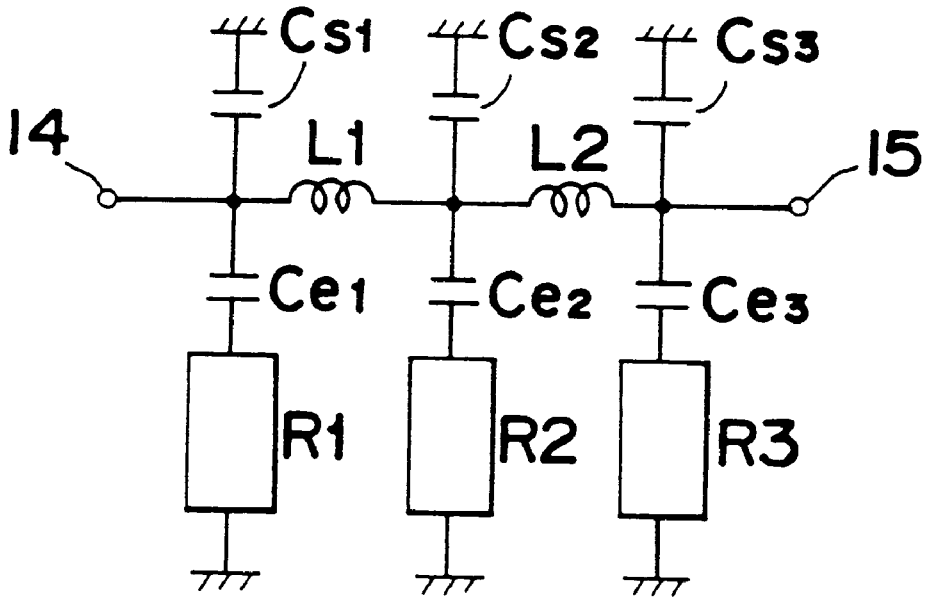
FIG. 20 is an equivalent circuit diagram of a dielectric filter in accordance with the eighth embodiment.

FIG. 20 is an equivalent circuit diagram of a dielectric filter in accordance with the eighth embodiment. In FIG. 20, reference characters R1, R2, R3 are resonators formed by the internal conductors 16, 17, 18 shown in FIG. 18. Reference characters Ce1, Ce2, Ce3 are capacitors constructed between the internal conductors 16, 17, 18 and the electrodes Ce11, Ce12, Ce13. Reference numerals 14, 15 function as terminals of this three-stage band stop filter, namely, the signal input, output terminals.

In FIG. 18 through 21, the construction with the base plates 2 and 3 being separated from each other is an example. A dielectric block with the base plates 2, 3 being integrated may be used as in the first embodiment.

(Ninth Embodiment)

Figure 21:
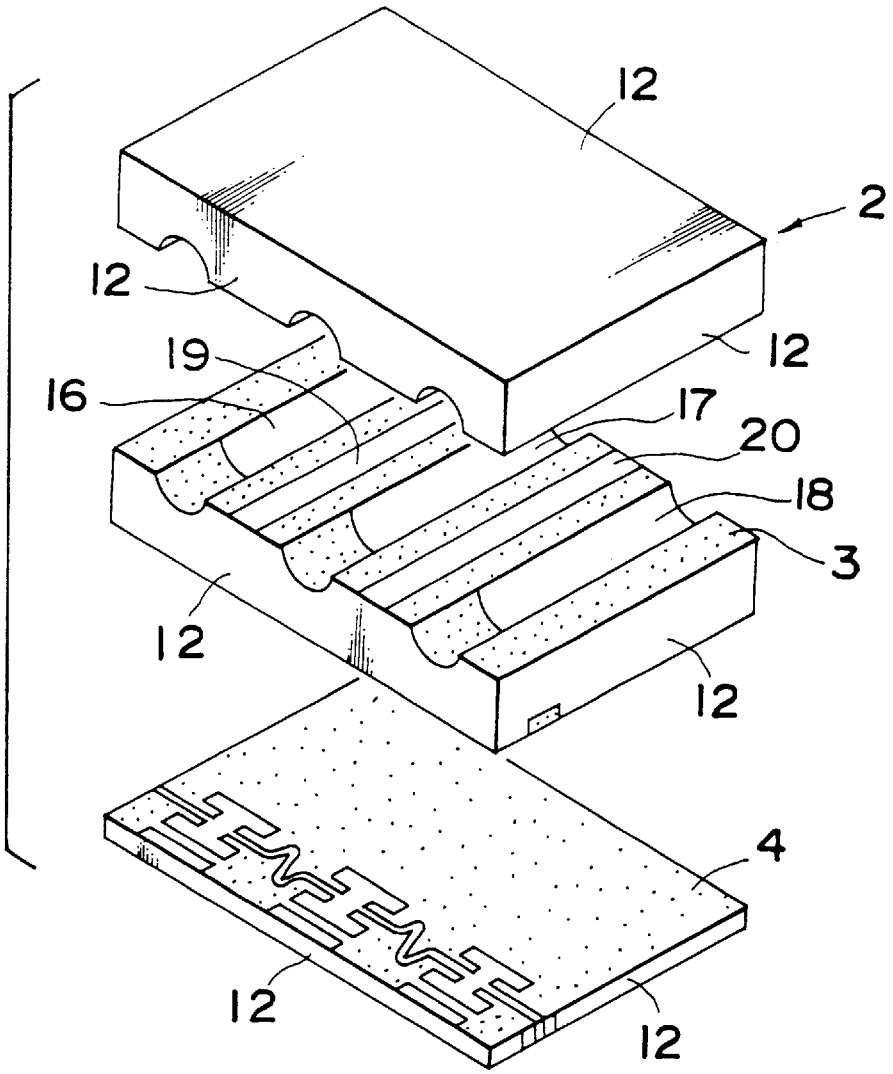
FIG. 21 is an exploded perspective view of a dielectric filter in accordance with a ninth embodiment.
Figure 22:
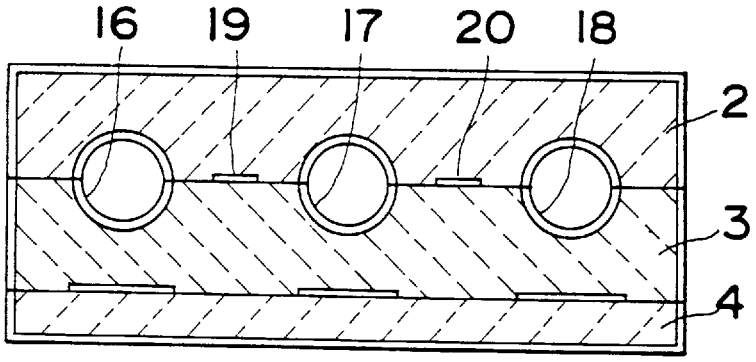
FIG. 22 is a sectional view of the dielectric filter in accordance with the ninth embodiment.

FIG. 21 is an exploded perspective view before the assembling operation of the dielectric filter in accordance with a ninth embodiment. FIG. 22 is a sectional view after the assembling operation thereof. In both the drawings, reference numerals 2, 3, 4 are respectively dielectric base plates. The different point from the eighth embodiment shown in FIG. 18 is that shielding electrodes 19, 20 are respectively disposed among the internal conductors 16, 17, 18. The electromagnetic field emitted by the adjacent resonators is screened with the shielding electrodes 19, 20 by the provision of the shielding electrodes 19, 20 in this manner so as to make the coupling between the resonators smaller, so that characteristics of a bandstop filter can be retained without a wider interval between the resonators.

(Tenth Embodiment)

Figure 23:
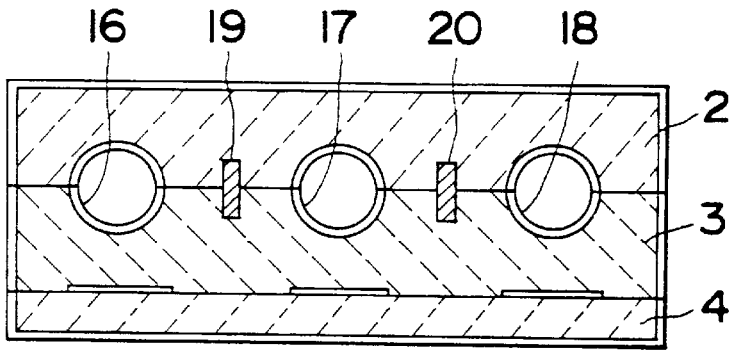
FIG. 23 is a sectional view of a dielectric filter in accordance with a tenth embodiment.

The sectional view of the dielectric filter in accordance with a tenth embodiment is shown in FIG. 23. The different point from the ninth embodiment shown in FIG. 22 is that the thickness of the shielding electrodes 19, 20 increases so as to provide a larger shielding effect between the resonators. Such shielding electrode is in respective grooves formed in the dielectric basic plates 2, 3 so that the conductive material is buried within the groove.

(Eleventh Embodiment)

Figure 24:
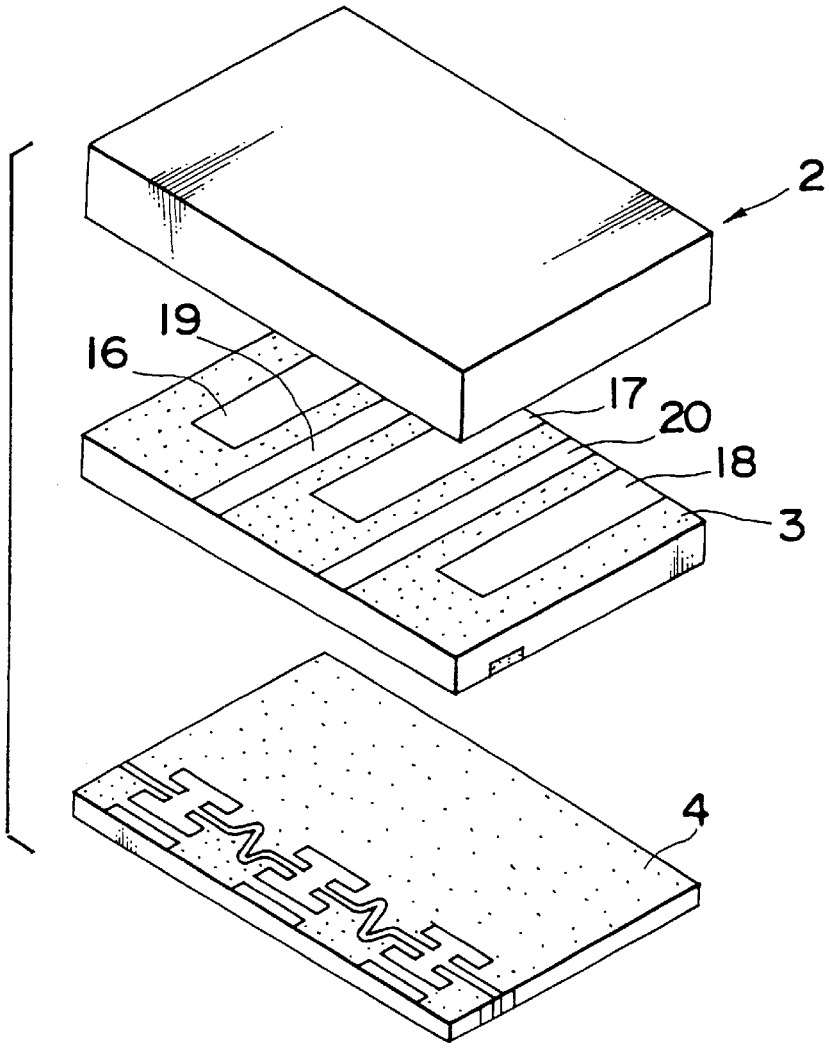
FIG. 24 is an exploded perspective view of a dielectric filter in accordance with an eleventh embodiment.

FIG. 24 is an exploded perspective view before the assembling operation of the dielectric filter in accordance with an eleventh embodiment. The different point from the example shown in FIG. 21 in construction is that resonance electrodes 16, 17, 18 composed of strip lines and shielding electrodes 19, 20 are provided on the dielectric base plate 3. Strip lines used as resonance electrodes in this manner form conductive patterns on the respective dielectric ceramic green sheets so that the manufacturing operation involves a laminating and integral cofiring operation.

The eighth through the eleventh embodiments are band stop filter. Bandpass filter can be constructed in the same construction by the change in the shape of the additional electrode.

An example of a composite integral type dielectric filter is shown hereinafter as a twelfth embodiment.

(Twelfth Embodiment)

Figure 25:
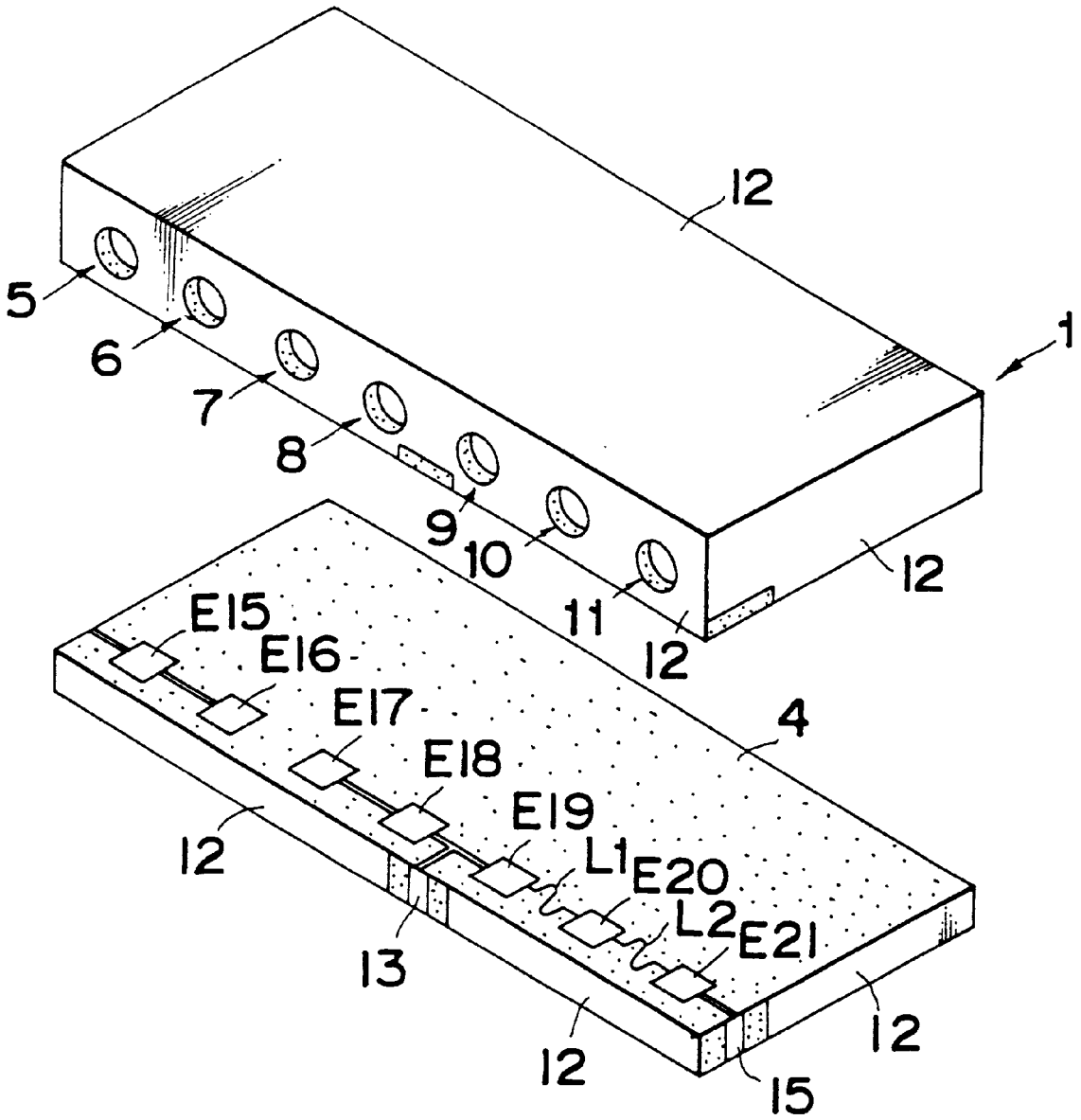
FIG. 25 is an exploded perspective view of a dielectric filter in accordance with a twelfth embodiment.

FIG. 25 is an exploded perspective view before the assembling operation of the dielectric filter in accordance with a twelfth embodiment. In FIG. 25, reference numeral 1 is a dielectric block, reference numeral 4 is a dielectric base plate. Internal conductor formed holes 5 through 11 are formed in the dielectric block 1 and an external conductor 12 is formed on five faces except for the connection face with the dielectric base plate 4. Additional electrode patterns shown with reference characters E15 through E21 and reference numerals L1, L2 are formed on the construction faces with respect to the dielectric block 1 of the dielectric base plate 4. The external conductors 12 are formed on the other faces and signal input, output electrodes (13, 15 and so on) are extended onto the face (reverse face in the drawing) opposite to the face with the additional electrode formed thereon. In the drawing, the electrodes E15, E16 effect the capacity connection between the internal conductors within the internal conductor formed holes 5, 6 and electrodes E17, E18 effect capacity connection between the internal conductors within the internal conductor formed holes 7, 8. The electrodes E19, E20, E21 respectively effect capacity connection with the internal conductors within the internal conductor formed holes 9, 10, 11 so as to respectively connect with inductors L1 and L2 between the electrodes E19 and E20 and electrodes E20 and E21. By this construction, the resonators formed by the internal conductor formed holes 5 through 8 function as four stages of polarized band passing filters, and the resonator by the internal conductor formed holes 9, 10, 11 function as three stages of band stopping filters. An integral type of dielectric filter with such combined band pass filter and band stop filter can be used as an antenna sharing device, combining device and so on.

In the example of FIG. 25, the dielectric block 1 and the dielectric base plate 4 are integrally constructed. Either of the dielectric block 1 and the dielectric base plate 4 may be divided into two. Although the electrode E18 for constructing the final stage of the band passing filter is directly connected to the electrode E19 for constructing the final stage of the band stopping filter so as to construct the sharing device on the combining device, the connecting operation may be effected by a transmission line for phase matching or by a phase shifting circuit formed by L, C elements without direct connection of the connection portion of two filters. The combination of two filters may be made band passing filters or band stopping filters in addition to the example.

(Thirteenth Embodiment)

Figure 26:
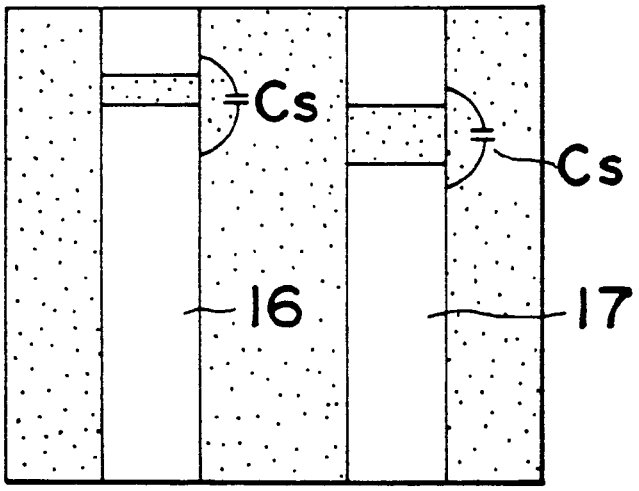
FIG. 26 is an explanatory view in accordance with a thirteenth embodiment, (A) being a sectional view thereof, (B) being a front view thereof.
Figure 26:
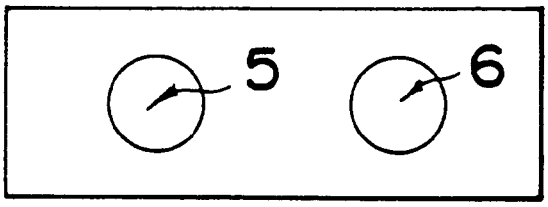

FIG. 26 is an illustrating view of a dielectric filter in accordance with a thirteenth embodiment.

Although the open portion of the internal conductor or the resonance electrode is formed near the end face of the dielectric block in the first through twelfth embodiments shown hereinabove, the open portion of the internal conductor may also be formed within the dielectric block. In FIG. 26, (A) is a cross sectional view with two internal conductor formed holes of the dielectric block being extended through, (B) is a front face view seen from the short-circuit face side of the dielectric block. Internal conductors 16, 17 are formed within the internal conductor formed holes 5, 6 like this, and an open portion is provided therein so as to form the tip end capacity Cs in the portion. The electromagnetic field leakage is further restrained thereby, and influences by the adjacent metallic unit can be further restrained.

The characteristic adjusting method of the dielectric filter will be described hereinafter with reference to FIG. 27 through FIG. 32.

Figure 27:
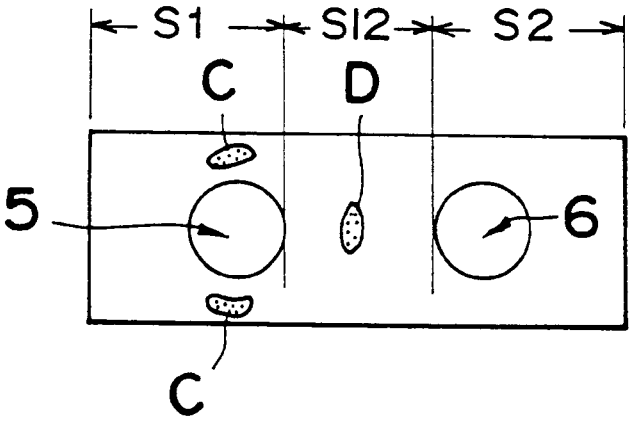
FIG. 27 is a front face view of a dielectric filter showing a dielectric filter characteristic adjusting method.
Figure 28:
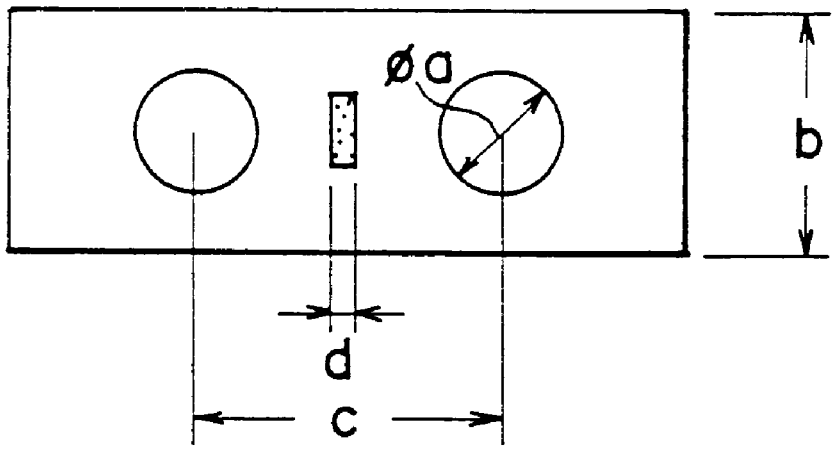
FIG. 28 is a front face view showing a conductor deleted example for the characteristic measurement of the dielectric filter.
Figure 29:
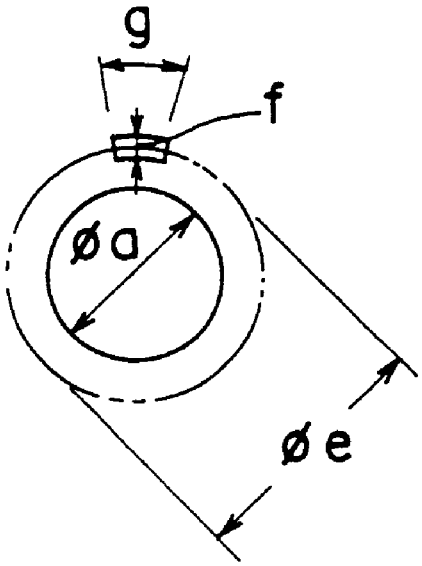
FIG. 29 is a partial front face view showing the conductor deleted example for the characteristic measurement of the dielectric filter.
Figure 30:
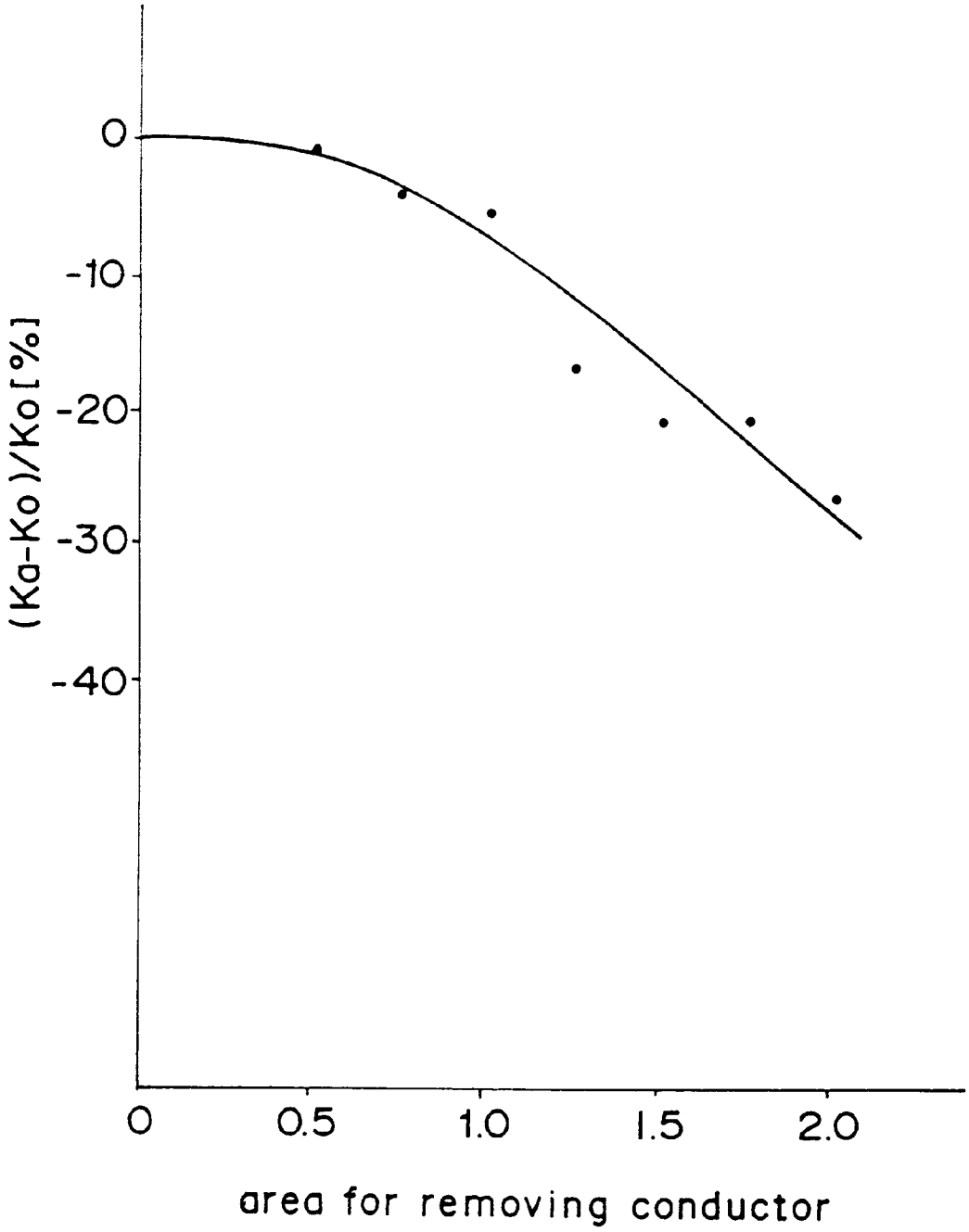
FIG. 30 is a view showing the measurement result of the coupling coefficient change in the dielectric filter.
Figure 31:
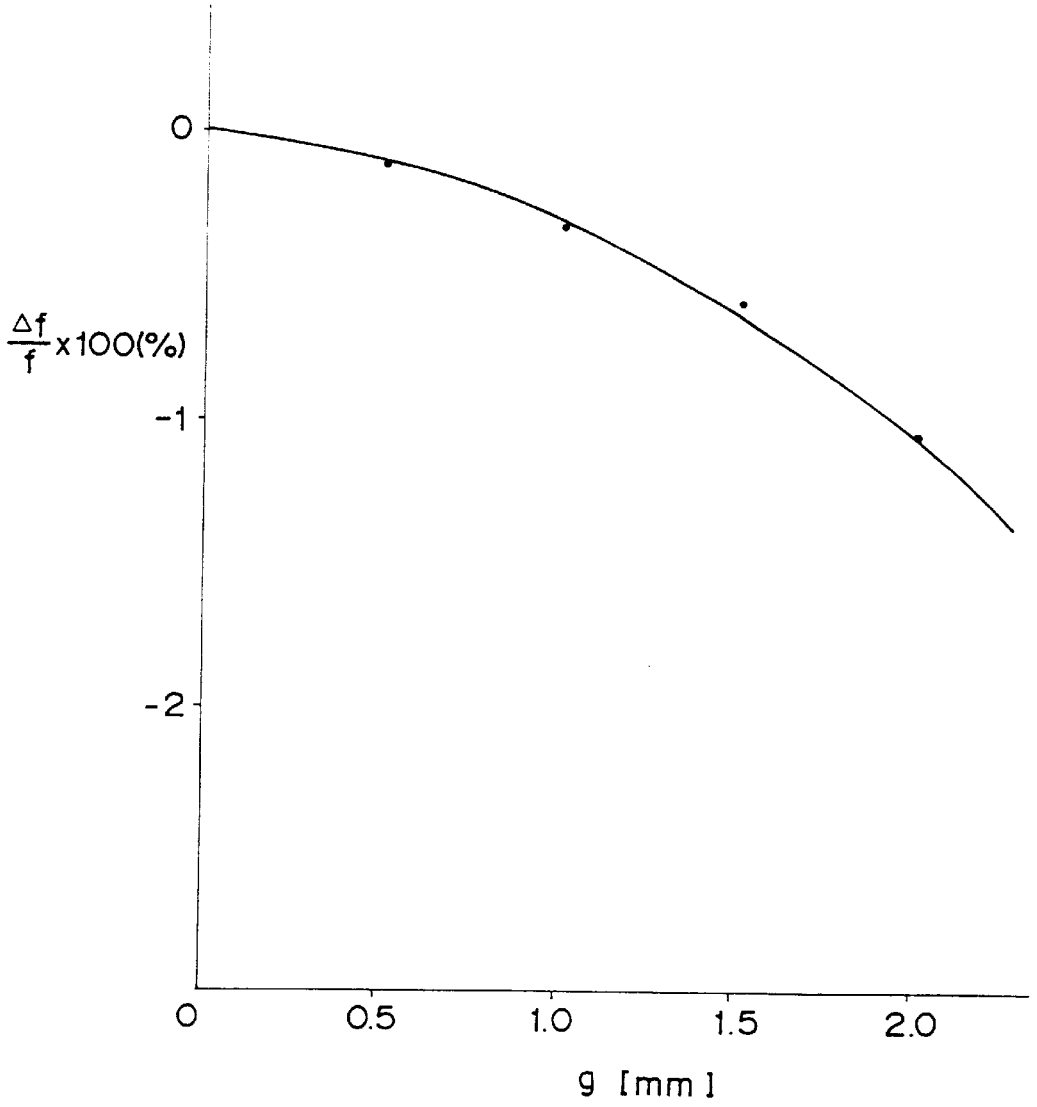
FIG. 31 is a view showing the measurement result of the resonance frequency change in the dielectric filter.

FIG. 27 is a front face view of the dielectric block seen from the short-circuit face side. Reference characters C, D are portions where the conductor has been removed from the short circuit face, and the dielectric beneath those portions is also removed. The conductor and the dielectric in the region of reference character S1 in FIG. 27 are partially deleted so that the resonance frequency of the resonator formed by the internal conductor formed hole 5 is lowered. When the conductor and the dielectric are partially deleted in the region of the S2 similarly, resonance frequency of the resonator formed by the internal conductor formed hole 6 is lowered. When the conductor and the dielectric are partially deleted in the region of the S12, coupling degree between both the resonators is lowered. The examples of changing the coupling coefficients by the deletion of the conductor and the dielectric are shown in FIG. 28 and FIG. 30. As in FIG. 28, the conductor deletion portion of the width d is provided in the middle position between two coupling holes so as to measure the changes in the coupling coefficients when the area S changes. In FIG. 28, a=2.0 mm, b=4.0 mm, c=5.0 mm. In FIG. 30, the abscissa is a conductor deletion area S, and the ordinate is a change ratio of the coupling coefficients where the coupling coefficient is Ko in the case of S=0, and the coupling coefficient after the conductor deletion is Ka. The coupling coefficient can be changed by adjusting the conductor deletion area among the internal conductors on the short-circuit face. FIG. 29 and FIG. 31 show the adjustment examples of the resonance frequency. A conductor deletion portion of the length g, the width f is provided in a location away by a given interval from the internal conductor formed hole as shown in FIG. 29 so as to measure the resonance frequency when the length g has been changed. In FIG. 29, a=2.0 mm, e=3.0 mm, f=0.5 mm. In FIG. 31, the abscissa is length g, the ordinate shows variation amount in the resonance frequency with the resonance frequency in a case of g=0 being a reference. The resonance frequency can be adjusted by the deletion of conductor material at the internal conductor formed hole periphery on the short-circuit face.

Figure 32:
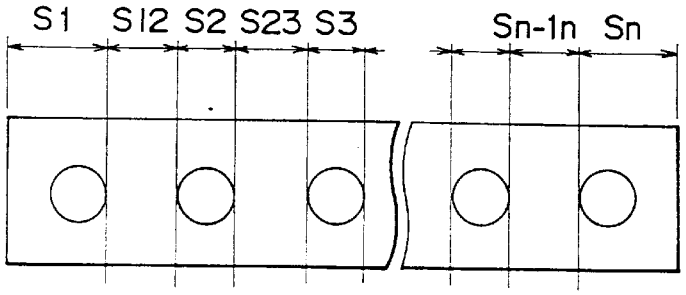
FIG. 32 is a front face view of the dielectric filter.

Although a two-stage of dielectric resonator is shown in the examples shown in FIG. 27 through FIG. 31, the dielectric resonator of three stages or more can be also similarly applied. In this case, the coupling degree among the resonators can be adjusted by the partial deletion of the conductor and the dielectric in the regions among the open portions S12, S23, . . . $S_{n-1n}$ of the internal conductor formed holes on the short-circuit face as shown in FIG. 32. The resonance frequency of the respective resonators can be adjusted by the partial deletion of the conductor and the dielectric of the regions S1, S2, S3 . . . Sn.

When the electrode and dielectric on the open face on the side with the internal conductor open portion formed side are partially deleted, the stress capacity between the resonator and the earth is reduced so that the adjustment may be effected in a direction of raising the resonance frequency.

According to the dielectric resonator of the present invention and the method of manufacturing it, the whole can be made smaller by the sharp deletion of the number of the parts items and the manufacturing cost thereof can be reduced. The different filter characteristics can be given by the designing of the additional electrode layer to be formed within the dielectric. Therefore, a filter having optional characteristics different in specification by the combination of the additional electrode layer can be constructed with the resonator portion being standardized, thus considerably improving the degree of freedom in the designing of the dielectric filter.

(Fourteenth Embodiment)

Figure 33:
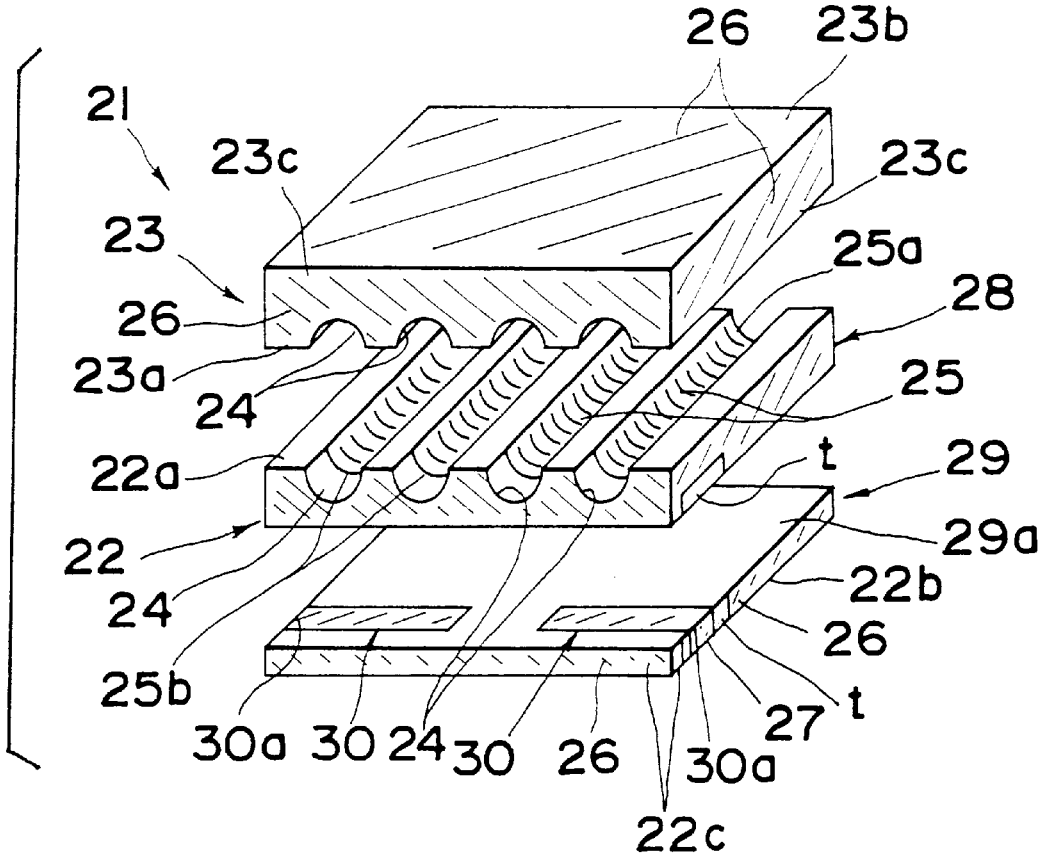
FIG. 33 is an exploded perspective view for illustrating a polarized construction of a tri-plate type of dielectric filter in accordance with a fourteenth embodiment of the present invention.
Figure 34:
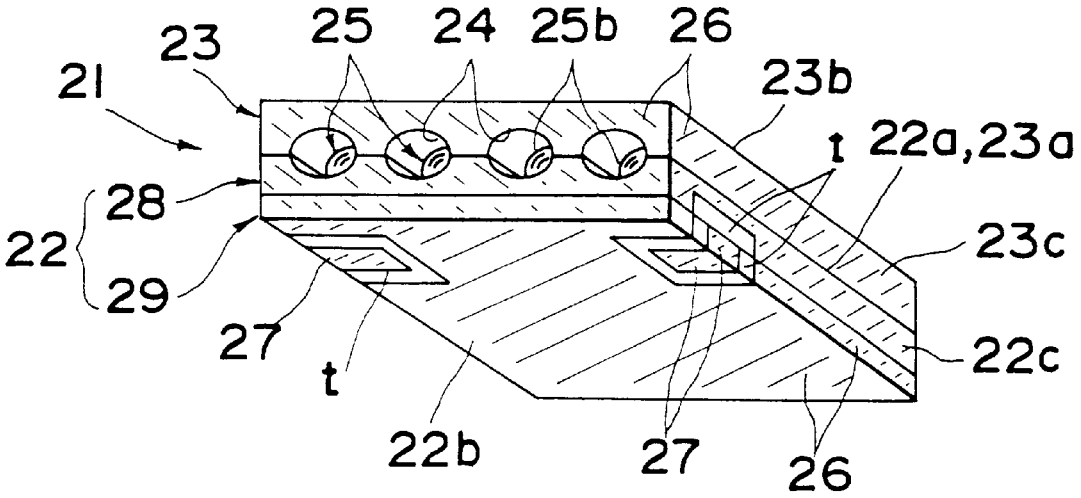
FIG. 34 is a perspective view of a tri-plate type of dielectric filter in the fourteenth embodiment.

FIG. 33 and FIG. 34 are views for illustrating the polarization construction of the dielectric filter in a fourteenth embodiment of the present invention. In the fourteenth embodiment, a case of application to a tri-plate type of dielectric filter will be described.

In FIG. 33, reference numeral 21 is a tri-plate type dielectric filter to which the present embodiment construction has been applied. This filter is constructed with first main faces 22*a*, 23*a* of a pair of dielectric base plates 22, 23 being opposite stuck together. Semi-circular concave portions 24 extending across both the end edges of the base plates 22, 23 are formed at an interval on the first main faces 22*a*, 23*a* of the respective dielectric basic plates 22, 23 with circular shaped through-holes being formed by both the concave portions 24. The resonance electrode 25 is formed on the internal surface of each concave portion 24. The opposite resonance electrodes 25 are electrically connected with each other. One end 25*a* of each resonance electrode 25 is positioned at one side of the above described dielectric base plates 22, 23 and the other side end 25*b* is positioned on the inside away from the other side of the dielectric base plates 22, 23.

An earth electrode 26 is formed on all the faces of the other main faces 22*b*, 23*b* of both the dielectric base plates 22, 23 and the respective side faces 22*c*, 23*c*. One side face 25*a* of each resonance electrode 25 is electrically connected with the earth electrode 26. The input, output electrodes 27 are formed on the left, right side faces 22*c*, 23*c* of the dielectric base plate 22, and the other main face 22*b* of the lower portion. A gap t is provided between the respective input, output electrodes 27 and the above described earth electrode 26.

The dielectric base plate 22 of the above described lower portion is of two-part construction including a first base plate portion 28 and a second base plate portion 29. Both the base portions 28, 29 are cut along the axial direction of the concave portion 24 of the dielectric base plate 22. A pair of polarized electrodes 30 extending towards the central portion from the left, right end edges of the basic plate portion 29 are formed on the front portion of the disconnection face 29*a* of the second base plate portion 29. The external end faces 30*a* of both the polarized electrodes 30 are connected with the above described input, output electrodes 27 so that the polarized capacity for high frequency band use is formed. The polarized electrode 30 is enclosed within the dielectric base plate 22 by the operation by which the above described first, second base plate portions 28, 29 are adhered.

The operational effect of the present embodiment will be described hereinafter.

According to the tri-plate type of dielectric filter 21 of the present embodiment, the dielectric basic plate 22 is divided into two portions of first, second base plate portions 28, 29. The polarized electrode 30 is formed on the disconnected face 29*a* of the second base plate portion 29. As the polarized electrode 30 is enclosed within the dielectric base plate 22, all the faces of the other main faces 22*b*, 23*b* of the above described dielectric base plates 22, 23 may be made earth electrodes 26 so that obstacles to the currents flowing through the earth electrodes 26 can be removed. As a result, the reduction in the insertion loss can be improved by the avoidance of the deterioration in Qo value, thus improving the electrical characteristics.

(Fifteenth Embodiment)

In the above described embodiment, the dielectric base plate 22 of the lower portion is divided into first, second basic plate portions 28, 29. A polarized electrode 30 is formed on the disconnection face 29*a* of the second base plate portion 29 and also, the polarized capacity for high frequency band use is provided with the external end faces 30*a* of both the polarized electrodes 30 being connected with the input, output electrodes 27. The polarized construction of the present invention is not so restricted. For example, FIG. 35, FIG. 36 respectively illustrate the polarized construction related to the FIG. 15, FIG. 16 embodiments, where like parts are designated by the same reference numerals in FIG. 1.

Figure 35:
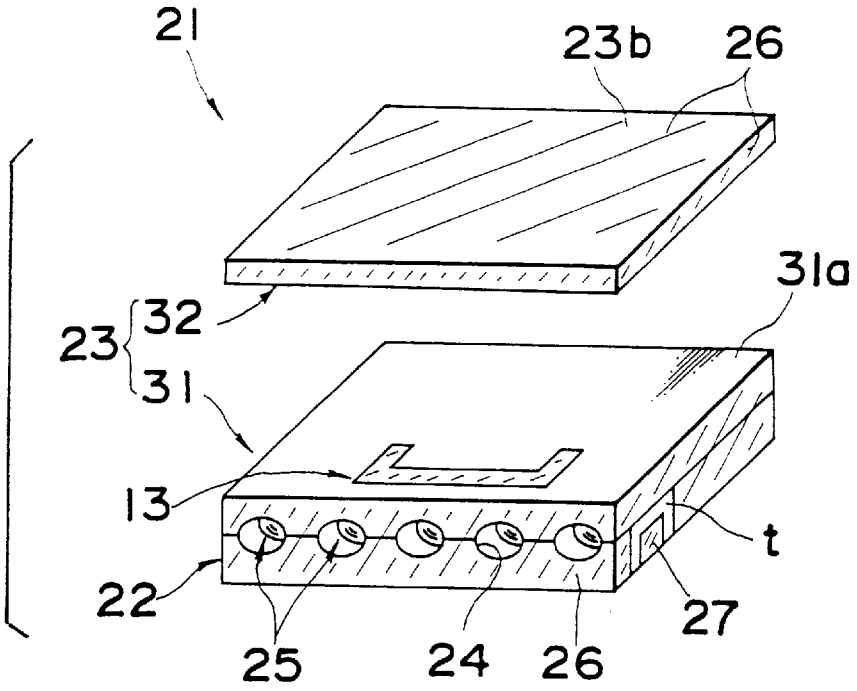
FIG. 35 is an exploded perspective view showing the polarized construction of a tri-plates type of dielectric filter in a fifteenth embodiment of the present invention.

The polarized construction of the fifteenth embodiment shown in FIG. 35 is divided into the first, second base portions 31, 32 in the dielectric base plate 23 in the upper portion. The polarized electrode 33 is formed in the center portion of the disconnection face 31*a* of the first base plate 31 so as to provide the polarized capacity for low frequency band use.

(Sixteenth Embodiment)

Figure 36:
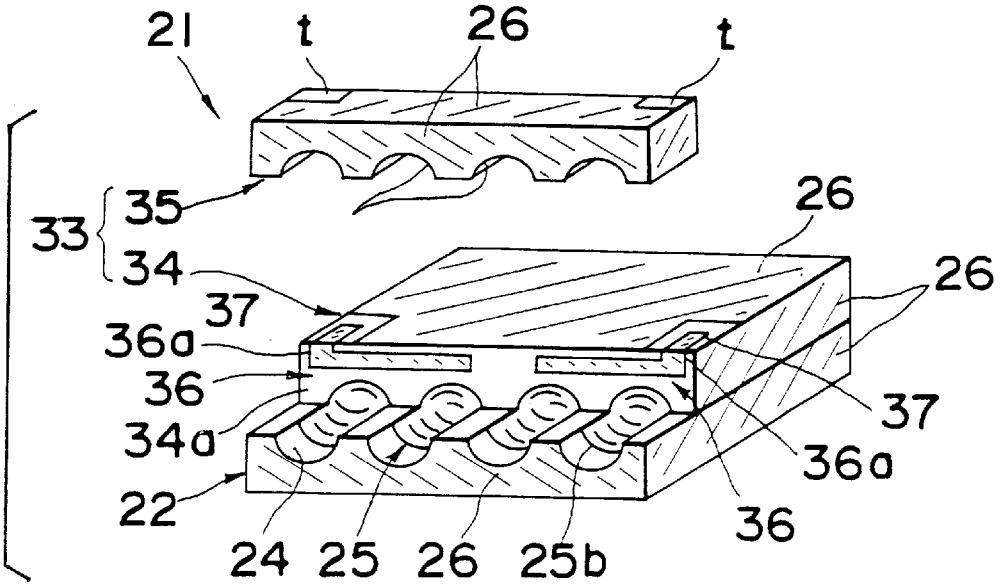
FIG. 36 is an exploded perspective view showing the polarized construction of a sixteenth embodiment of the present invention.

In a sixteenth embodiment construction shown in FIG. 36, the first, second base plate portions 34, 35 are formed with the front portion of the dielectric base plate 23 being disconnected in an axial right-angled direction of the resonance electrode 25, a pair of polarized electrodes 36 are formed in the longitudinal disconnection face 34*a* of the first base plate portion 34, the external end face 36*a* of the respective polarized electrode 36 is connected with the input, output electrodes 37 formed on the other main face 23*b* of the above described dielectric base plate 23 so as to provide the polarized capacity for high frequency band use.

In the above described fourteenth through sixteenth embodiments, a dielectric filer is illustrated by way of example where a concave portion 24 is formed in each dielectric base plate 22, 23, and a resonance electrode 25 is formed on the inner surface of the respective concave portion 24. The present invention can be applied even to a resonance electrode extending in a band shape to a flat shaped dielectric base plate, and to a resonance electrode only formed on either of the dielectric base plates.

(Seventeenth Embodiment)

Figure 37:
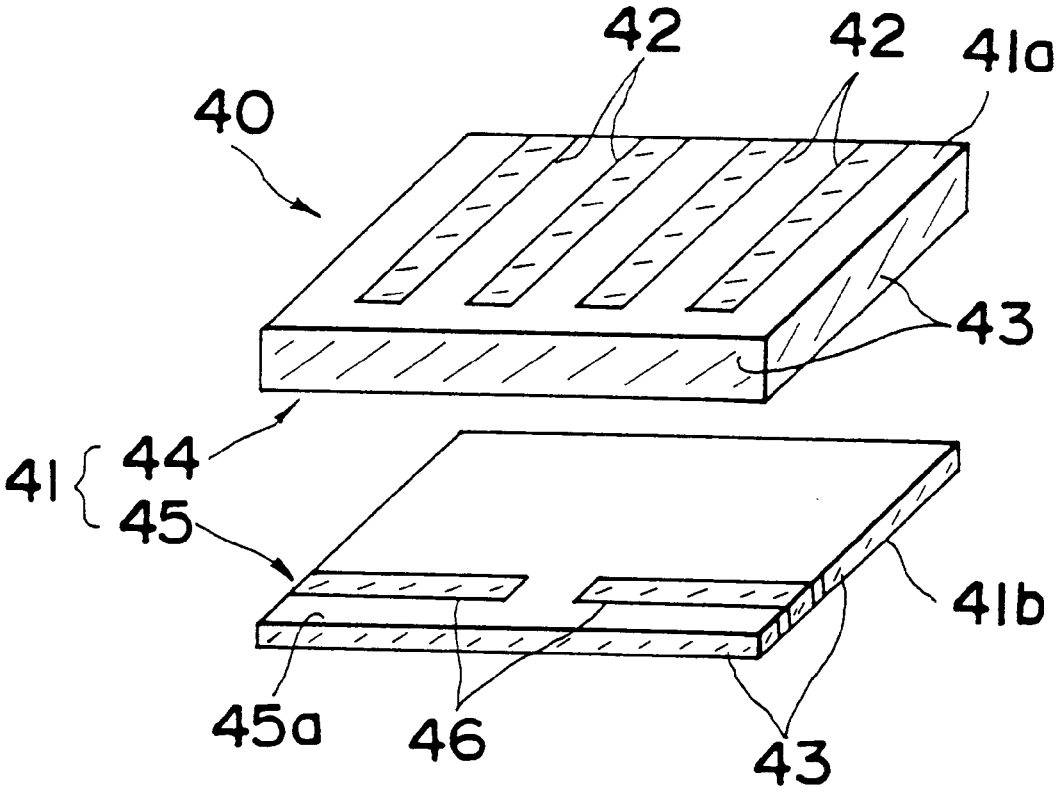
FIG. 37 is an exploded perspective view showing the polarized construction of a strip line type of dielectric filter in accordance with a seventeenth embodiment of the present invention.

In the above described fourteenth through sixteenth embodiments, the dielectric filter is described by way of example where it has been applied to the tri-plates type dielectric filter. The present invention can be applied even to such a strip line type of dielectric filter as in the seventeenth embodiment shown in, for example, FIG. 37 without restriction to that embodiment. The strip line type of dielectric filter 40 has a plurality of resonance electrodes 42 formed extending in a band shape on first main face 41*a* of the dielectric base plate 41, and also has an earth electrode 43 formed on the other main face 41*b*. In this case, the above described dielectric base plate 41 is divided into first, second base plate portions 44, 45, and has a polarized electrode 46 formed on the disconnection face 45 of the second base plate portion 45, with an effect similar to each embodiment.

According to the dielectric filter of the present invention, a polarized electrode for effecting capacity connection mutually with resonance electrodes is formed within the dielectric base plate, so that the obstacle to the earth currents can be removed with an effect that the insertion loss can be improved with the corresponding avoidance of the deterioration in the Qo value.

(Eighteenth Embodiment)

Figure 38:
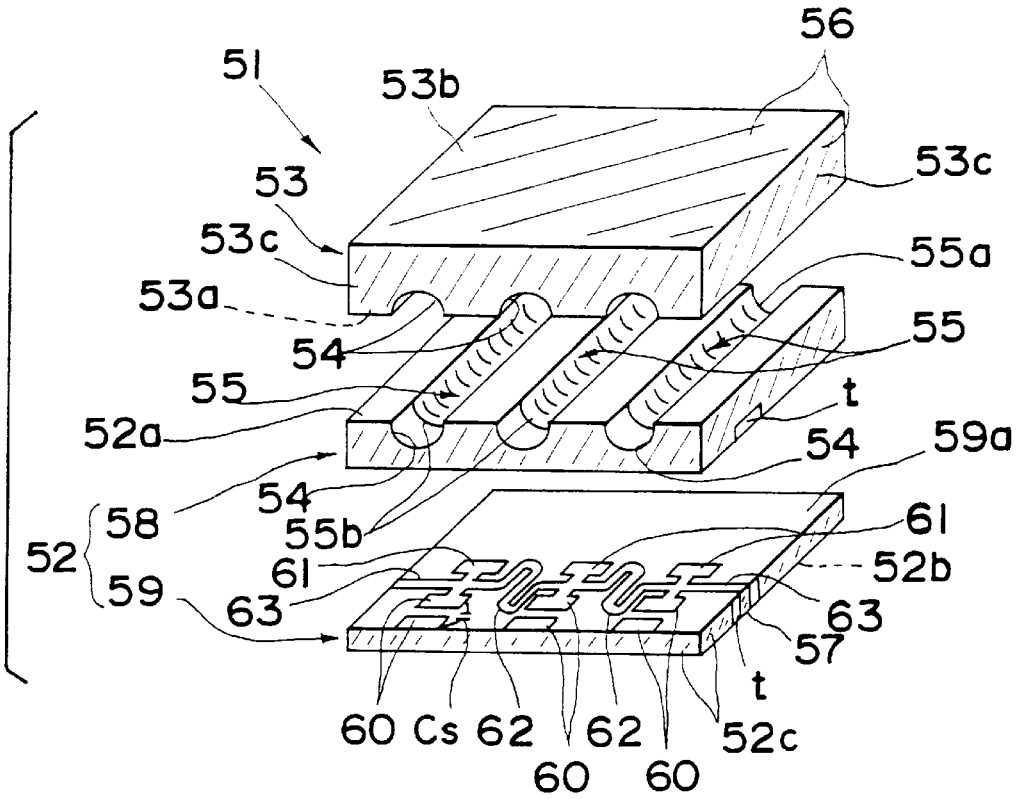
FIG. 38 is an exploded perspective view for illustrating a dielectric filter of a tri-plate construction in accordance with an eighteenth embodiment of the present invention.
Figure 39:
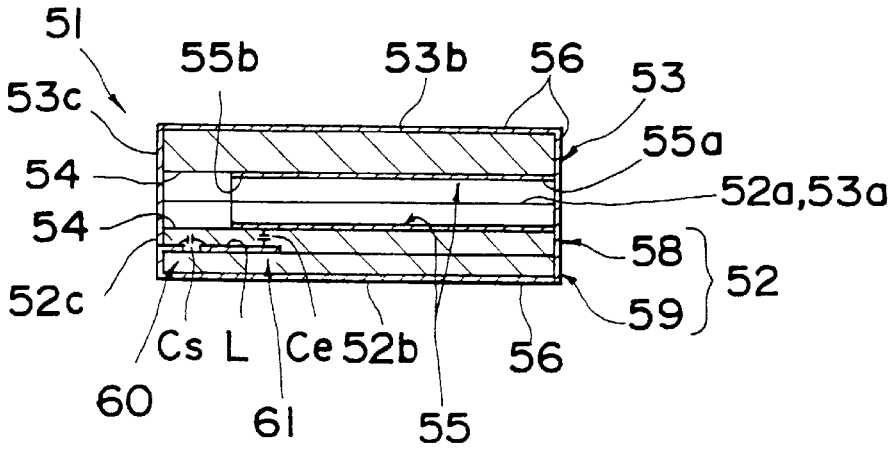
FIG. 39 is a sectional side face view of a dielectric filter in the eighteenth embodiment.

FIG. 38 and FIG. 39 are views for illustrating the dielectric filter by an eighteenth embodiment of the present invention.

In FIG. 38, reference numeral 51 is a dielectric filter of tri-plate construction to which the present embodiment construction has been applied. The dielectric filter 51 is composed with first-main faces 52*a*, 53*a* of a pair of dielectric base plates 52, 53 being opposite each other and stuck together. The semicircular concave portion 54 extending across both the end edges of the base plates 52, 53 is formed at an interval on first-main faces 52*a*, 53*a* of the respective dielectric base plates 52, 53, and circular through-holes are formed by both the concave portions 54. The resonance electrode 55 is formed on the internal surface of each concave portion 54 and the opposite resonance electrodes 55 are electrically connected with respect to each other. One side face 55*a* of each resonance electrode 55 is positioned in at edges at one end of the dielectric base plates 52, 53, and the other side face 55*b* is positioned on the inside away from the edges at the other end of the dielectric base plates 52, 53.

Earth electrodes 56 are formed on all the faces of the other main faces 52*b*, 53*b* of both the dielectric base plates 52, 53 and the respective side faces 52*c*, 53*c* with first side face 55*a* of each resonance electrode 55 being connected on the earth electrode 56. Input, output electrodes 57 are formed on the left, right side faces 52*c*, 53*c* of the dielectric base plates 52 of the above described lower portion and the other main face 52*b*. A gap t is provided between the respective input, output electrode 57 and the above described earth electrode 56.

The dielectric base plate 52 of the above described lower portion is of two-part construction of the first base plate 58 and the second base plate portion 59. Both the base plate portions 58, 59 are disconnected along the axial direction of the concave portion 54 of the dielectric basic plate 52.

Stray electrodes 60, coupling electrodes 61, and coil electrodes 62 characterized by the present embodiment are formed in pattern on the cut face 59*a* of the above described second base plate portion 59. The respective electrodes 60 through 62 are formed at the same time by, for example, a screen printing method. The above described respective stray electrodes 60 are formed in the positions facing the above described respective concave portions 54. One side thereof is positioned on the front end edge of the second base plate portion 59 and is connected with the earth electrode 56. The other side of the above described stray electrode 10 is positioned in a gap with respect to one side with the stray capacity Cs being formed between the stray electrodes 60.

The above described respective coupling electrodes 61 are formed opposite to the other side faces 55*b* of the above described respective resonance electrodes 55 so as to form the coupling capacity Ce with the coupling electrode 61 and the resonance electrode 55. The above described coil electrode 62 is positioned between the respective coupling electrodes 61 so as to form an inductance L. Both the ends of the above described respective coil electrode 62 are connected with the other side of the above described coupling electrode 61, the stray electrode 60, and are connected with the above described input, output terminals 57 through the lead electrode 63. The above described respective stray electrodes 60, the coupling electrodes 61, and the coil electrodes 62 are enclosed within the dielectric base plate 52 by the attachment operation between the above described first, second base plate portions 58, 59.

The operational effect of the present embodiment will be described hereinafter.

According to the dielectric filter 51 of the present embodiment, the dielectric base plate 52 is divided into the first, second base plate portions 58, 59 so as to pattern-form the stray electrodes 60, the coupling electrodes 61, and the coil electrodes 62 on the cut face 9a of the second base plate portion 59. The respective electrodes 60 through 62, the resonance electrode 55, the earth electrode 56 and input, output electrodes 57 are formed on the dielectric base plate 53, the first, second base plate portions 58, 59 so that it can be manufactured simply by the attachment operation thereof. As a result, the number of the parts can be reduced as compared with the connection with parts such as capacitor elements, coils and so on being engaged on the conventional base plate. The steps of the manufacturing operations can be omitted, thus correspondingly reducing the cost and improving the productivity. In the present embodiment, the cost can be reduced even from this point, because the conventional metallic case, the coupling terminal, input, output terminals can be made unnecessary.

(Nineteenth Embodiment)

Figure 40:
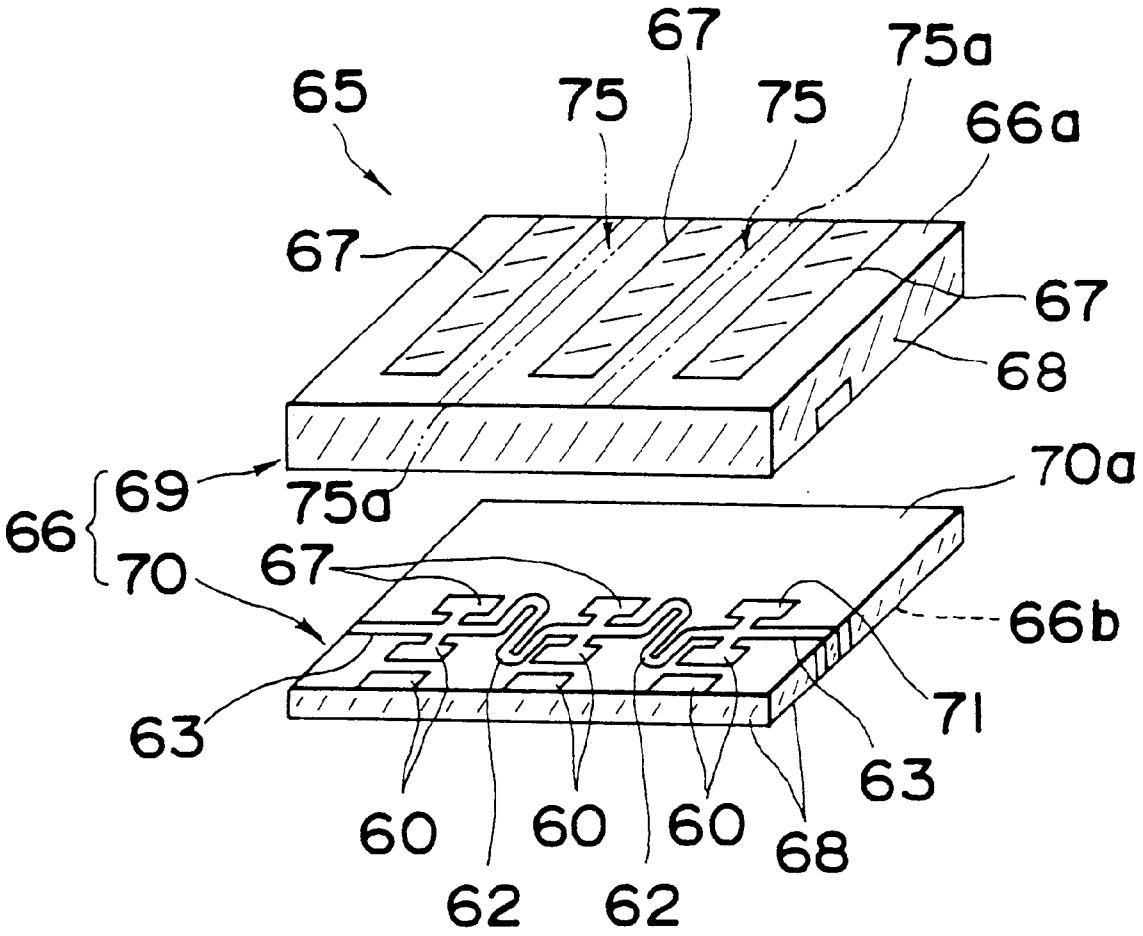
FIG. 40 is an exploded perspective view showing a dielectric filter of the strip line construction in a nineteenth embodiment of the present invention.

Although a dielectric filter of the tri-plate construction has been described by way of example in the above described embodiment, the present invention can be applied even to a dielectric filter of strip line construction as in a nineteenth embodiment shown in, for example, FIG. 40 without restriction to it. The dielectric filter 65 forms three stages of resonance electrodes 67 extending in a band shape on one main face 66a of the dielectric base plate 66, and also, forms the earth electrode 68 on the other main face 66*b*. Even in this case, the above described dielectric base plate 66 is divided into the first, second base plate portions 69, 70, and the above described stray electrode 60, the coupling electrode 61 and the coil electrode 62 are pattern formed on the cut face 70*a* of the second base plate portion 70 with an effect similar to the above described embodiment.

(Twentieth Embodiment)

Figure 41:
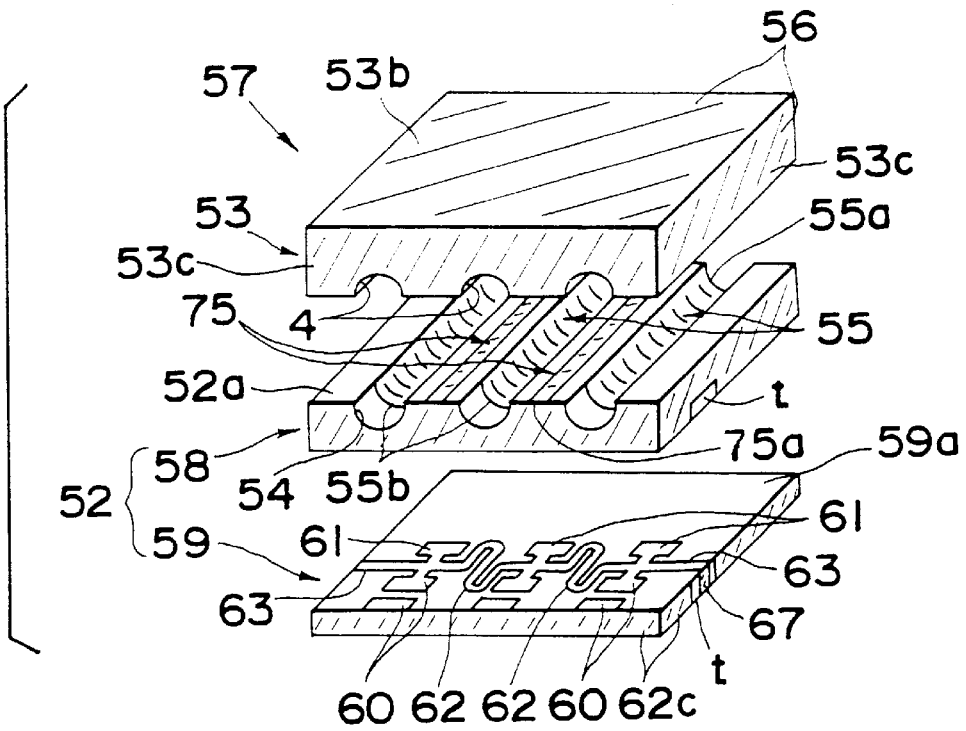
FIG. 41 is an exploded perspective view for illustrating the dielectric filter of the tri-plate construction of a twentieth embodiment in accordance with the present invention.
Figure 42:
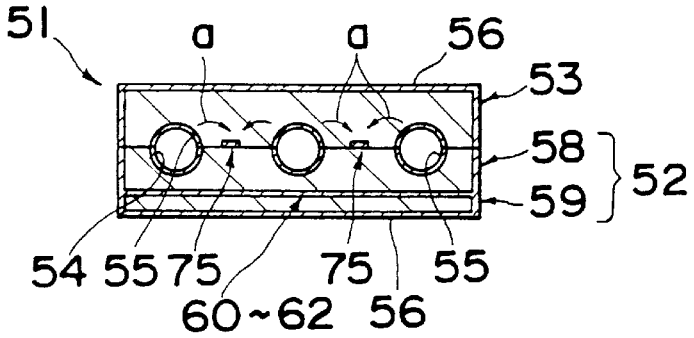
FIG. 42 is a sectional front face view of a dielectric filter in the twentieth embodiment.

FIG. 41 and FIG. 42 are views for illustrating a dielectric filter according to a twentieth embodiment in accordance with the present invention where like parts are designated by the same reference numerals as in FIG. 1.

The dielectric filter 51 in the present embodiment is approximately the same as in the above described embodiment. In the present embodiment, the shielding electrode 75 is formed between the adjacent resonance electrodes 55 of one main surface 52*a* of the above described dielectric base plate 52, and both the ends 75*a* of the shielding electrode 75 are connected with the earth electrode 56.

In accordance with the present embodiment, as both the ends 75*a* of the shielding electrode 75 are connected with the earth electrode 56 between the adjacent resonance electrodes 55 of the dielectric base plate 52, electric force lines emitting from both the resonance electrodes 55 are absorbed by the above described shielding electrode 75 and the mutual influence forces become weak so that the characteristics are not deteriorated if the above described resonance electrodes 55 are formed in proximity. As a result, the width of the dielectric base plate 52 may be made smaller, and all the parts may be made smaller in size with effects similar to the above described embodiment. The characteristic adjustment can be also effected easily by the formation of the above described shielding electrode 75.

When the shielding electrode is formed on the dielectric filter of the above described strip line construction shown in FIG. 40, the shielding electrode 75 (shown with two-dot chain lines) are formed between the adjacent resonance electrodes 67 of the dielectric base plate 65 as shown in FIG. 40 so as to connect both the ends 75*a* with the earth electrode 68. An effect similar to the above described embodiment can be obtained even in this case.

(Twenty First Embodiment)

Figure 43:
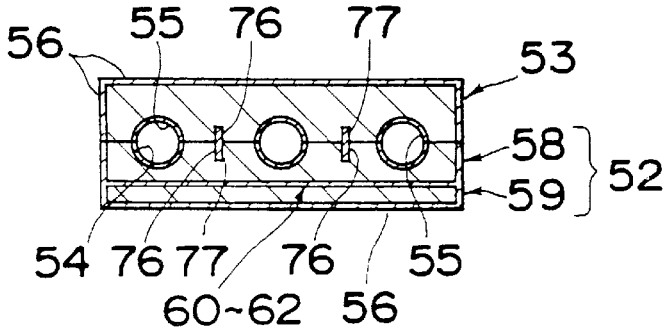
FIG. 43 is a sectional front face view showing a dielectric filter in a twenty-first embodiment.
Figure 44:
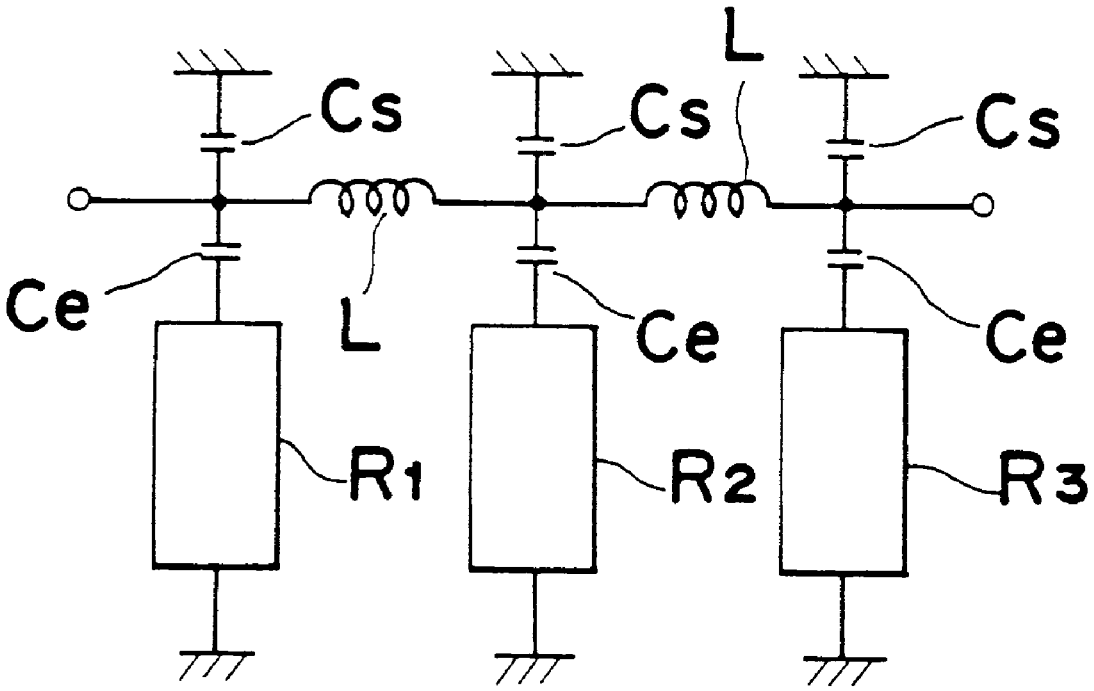
FIG. 44 is an equivalent circuit diagram of a general band elimination filter.

In the above described embodiment, although a case where the shielding electrode has been formed on the surface of the dielectric base plate is described by way of example, the present invention is not restricted to it. In the twenty first embodiment shown in, for example, FIG. 43, narrow grooves 76 are formed among the resonance electrodes 55 of the respective dielectric base plates 52, 53 and the electrode is placed within the groove 76 for forming the shielding electrode 77. In such a case, the shielding property can be further improved and the dielectric base plate can be further made smaller in size.

In accordance with such a invention as described hereinabove, coupling electrodes, stray electrodes and coil electrodes are pattern-formed within the dielectric base plate so as to reduce the number of the parts and lower the cost, with the effect that the productivity can be improved by omitting the steps of manufacturing operations. In the invention of this embodiment, shielding electrodes to be connected with the earth electrode are formed between the resonance electrodes of the above described dielectric base plate so that the resonance electrode interval can be narrowed without the deterioration of the characteristics, with an effect that the dielectric base plate can be made correspondingly smaller in size.

(Twenty Second Embodiment)

The construction of the dielectric filter in accordance with a twenty second embodiment of the present invention will be described in FIG. 45 through FIG. 48.

Figure 45:
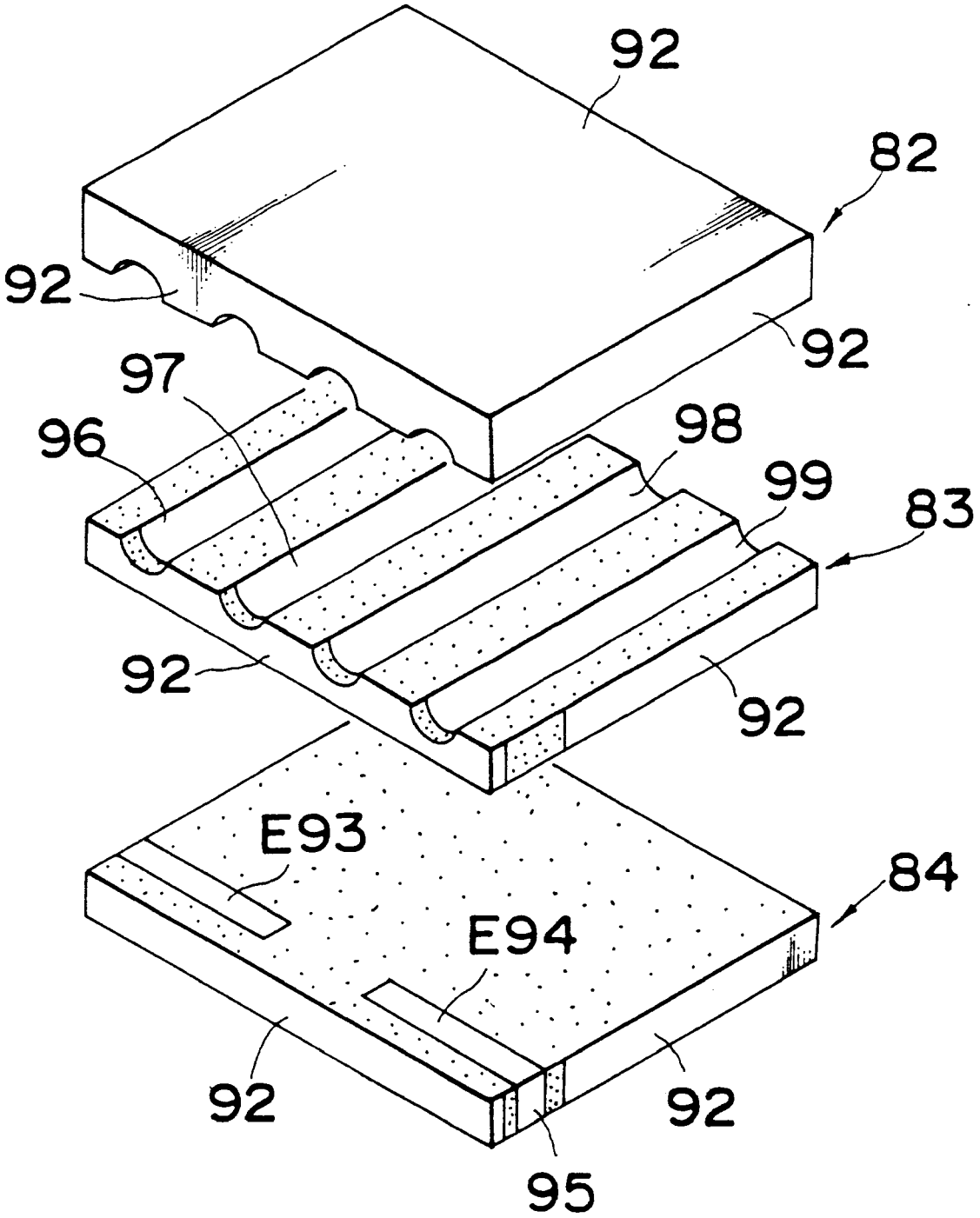
FIG. 45 is an exploded perspective view of a dielectric filter in accordance with a twenty-second embodiment.
Figure 46:
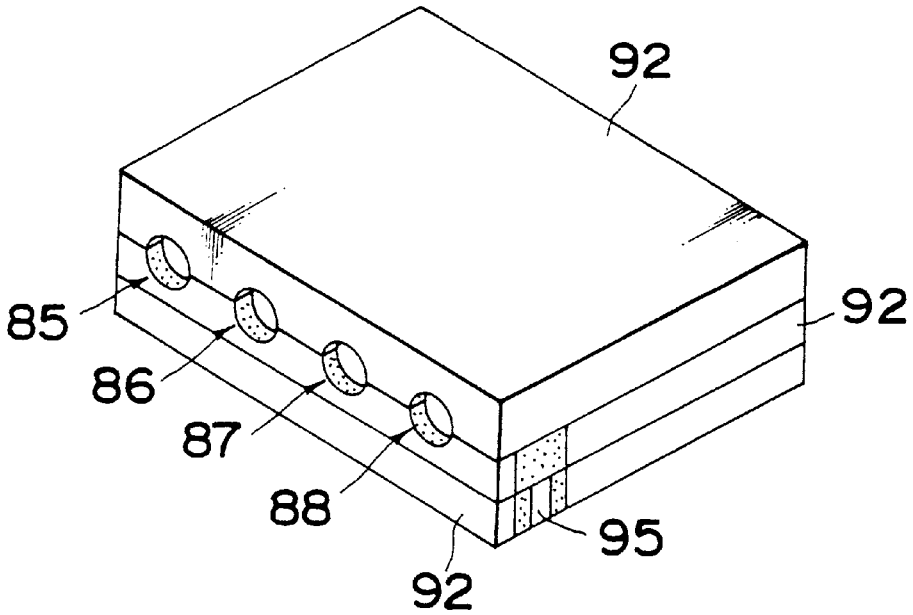
FIG. 46 is a perspective view of a dielectric filter in accordance with the twenty-second embodiment.

FIG. 45 is an exploded perspective view before the assembling operation of the filter. FIG. 46 is a perspective view after the assembling operation thereof. In FIG. 45, reference numerals 82, 83, 84 are respectively dielectric base plates. The dielectric base plates 82 and 83 have semicircular grooves respectively in both the connection faces and also, have internal conductors 96, 97, 98, 99 formed on the inside faces thereof. The tip end capacity is provided by the formation of the open portion near one end portion of each groove and is provided in each internal conductor so as to effect column-in connection between the resonators. The external conductor 92 is formed except for the outgoing portion in the vicinity of the signal input, output electrodes on four side faces of the dielectric base plate 83 except for the connection faces of the dielectric base plates 82, 84. The external conductors 92 are fully formed on five faces except for a face opposite to the dielectric base plate 83 of the dielectric base plate 82. On the dielectric base plate 84, the coupling electrodes E93, E94 are formed on the connection face of the dielectric base plate 83 and these coupling electrodes are extended so far as one portion of the reverse face through the side face of the dielectric base plate 84. Electrodes (95 and so on) extended so far as one portion of the reverse face from the side face of the dielectric base plate 84 are used as signal input, output electrodes. The external conductors 92 are formed on four side faces and the dielectric base plate 84 and the bottom face thereof except for the regions formed with signal input, output electrodes. Such a dielectric filter as shown in FIG. 46 is obtained by the layer-building operation of the three dielectric base plates 82, 83, 84 shown in FIG. 45. Reference numerals 85 through 88 in FIG. 46 are internal conductor formed holes formed with grooves.

Figure 47:
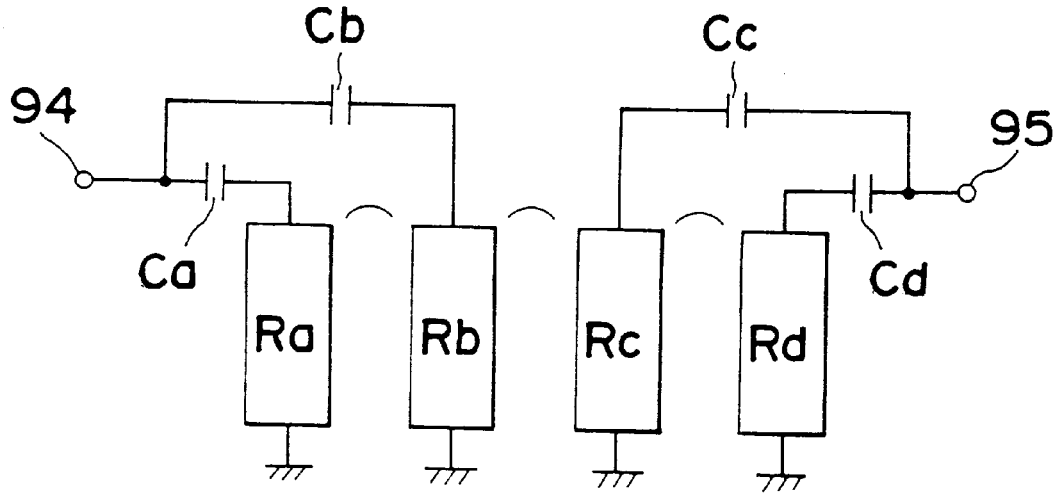
FIG. 47 is an equivalent circuit diagram of a dielectric filter in accordance with the twenty-second embodiment.
Figure 48:
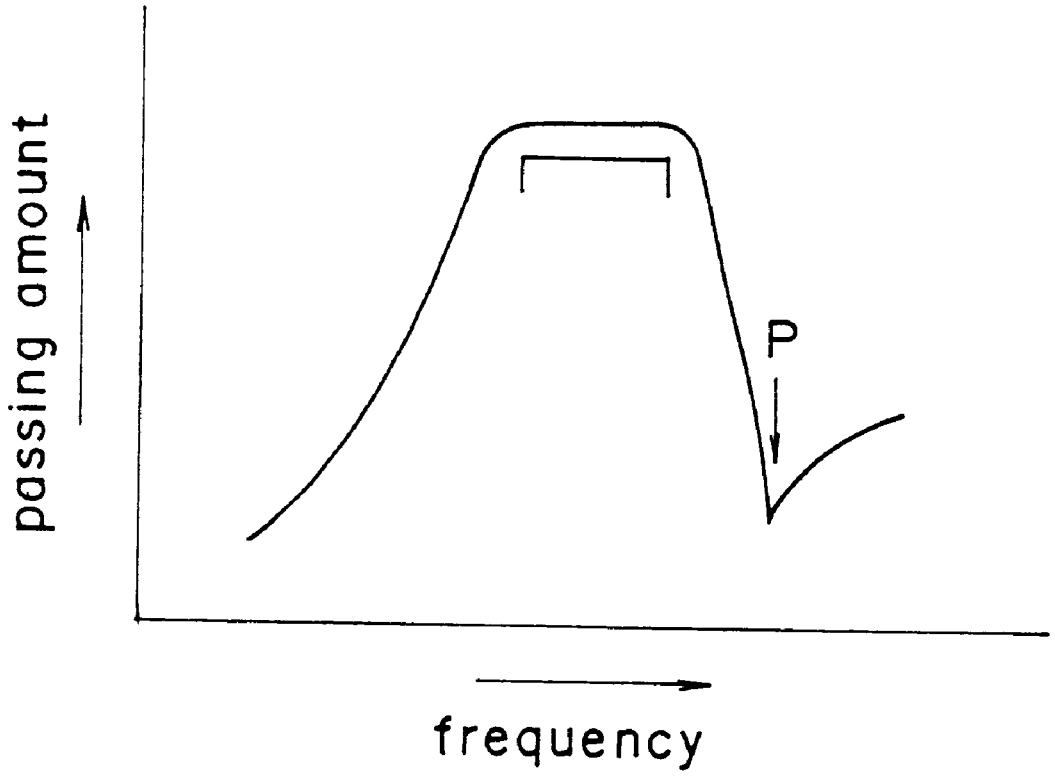
FIG. 48 is a characteristic view of a dielectric filter in accordance with the twenty-second embodiment.

FIG. 47 is an equivalent circuit diagram of a dielectric filter in accordance with the twenty-second embodiment. In FIG. 47, reference characters Ra, Rb, Rc, Rd are resonators formed by the internal conductors 96, 97, 98, 99 shown in FIG. 1. Reference characters Ca, Cb are capacitors to be formed between the resonators Ra, Rb and the signal input, output terminals 94, reference characters Cc, Cd are capacity to be formed between the resonators Rc, Rd and the signal input, output terminals 95. FIG. 48 is a graph showing transmission characteristics of a filter in accordance with the twenty second embodiment. A damping pole P is caused on the high-pass side of the passing band as shown in FIG. 48, by the capacity Cb, Cc shown in FIG. 47.

(Twenty Third Embodiment)

The construction of the dielectric filter in accordance with a twenty third embodiment is shown in FIG. 49 through FIG. 52.

Figure 49:
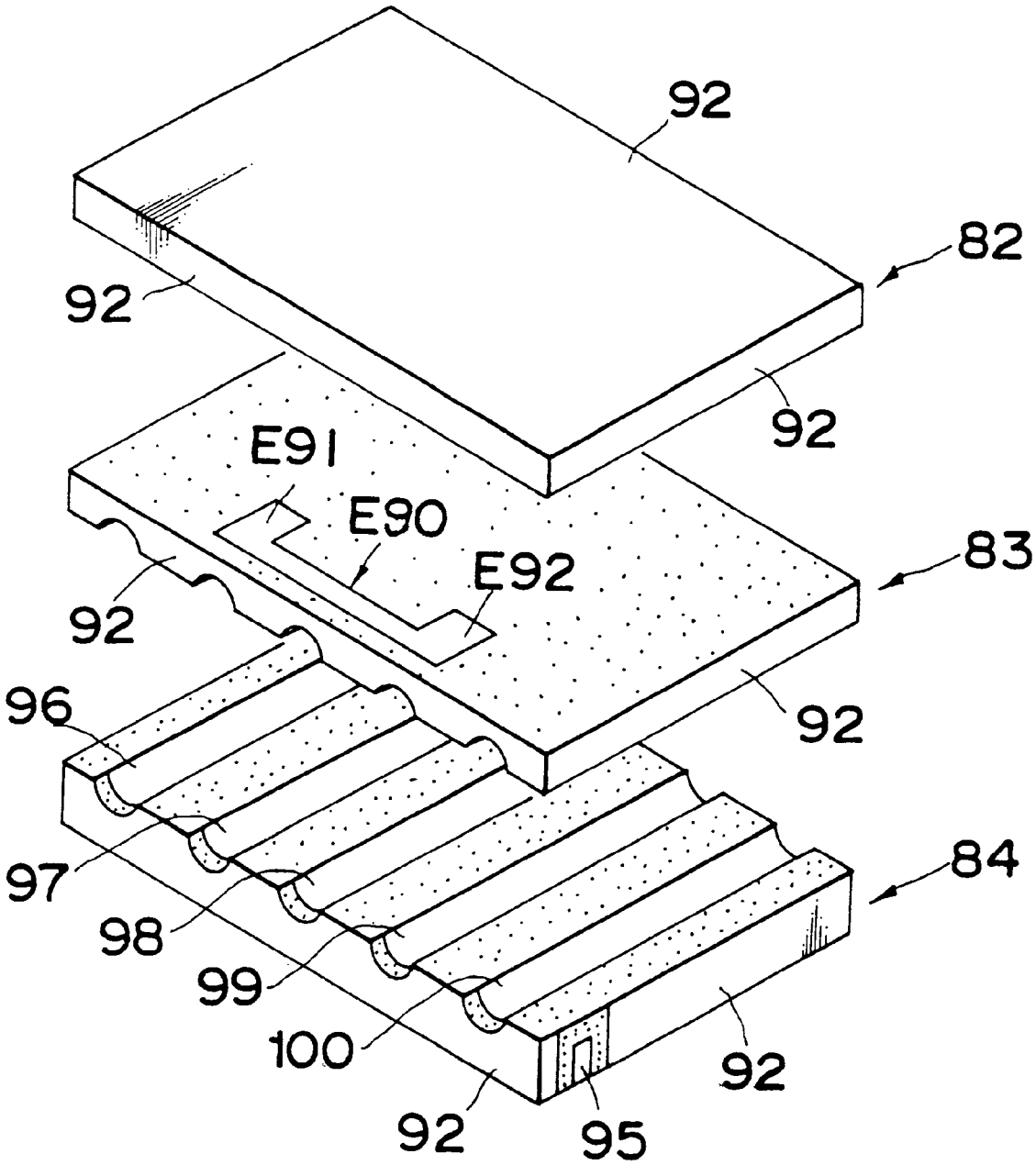
FIG. 49 is an exploded perspective view of a dielectric filter in accordance with a twenty third embodiment.
Figure 50:
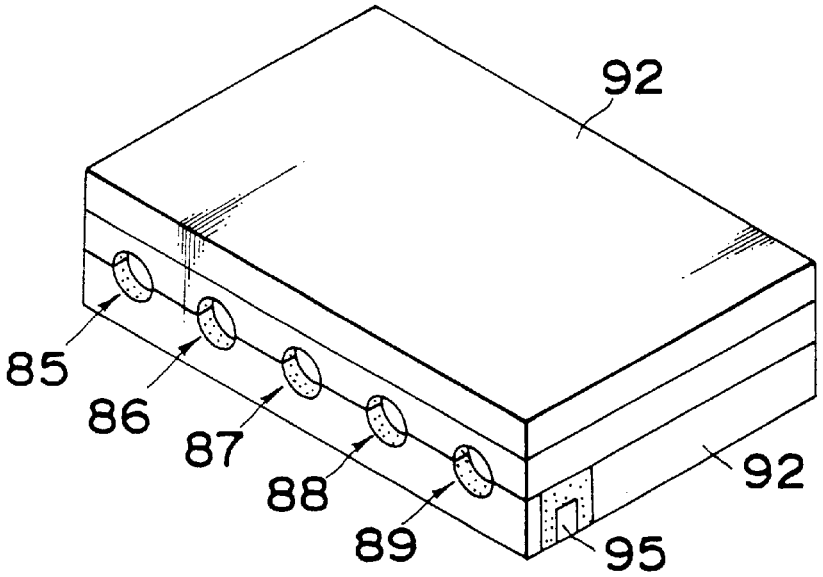
FIG. 50 is a perspective view of a dielectric filter in accordance with the twenty-third embodiment.

FIG. 49 is an exploded perspective view before the assembling operation of the dielectric filter. FIG. 50 is a perspective view after the assembling operation thereof. In FIG. 49, reference numerals 82, 83, 84 are respectively dielectric base plates. An external conductor 92 is formed on five faces except for a face opposite to the dielectric base plate 83. On the dielectric base plates 83 and 84, the semi-circular (sectional) grooves are formed respectively on both the connection faces and internal conductors 96, 97, 98, 99, 100 are formed on the inside faces thereof. The tip end capacity is provided by the formation of the open portion near the one end portion of each groove in each internal conductor so as to effect comb-line connection among the resonators. On the dielectric base plate 83, the external conductor 92 is formed on four side faces thereof, and the coupling electrode E90 is formed on the face opposite to the dielectric base plate 82. Portions shown with E91, E12 of the coupling electrode E90 form positions for effecting capacity connection respectively on the internal conductors 97, 99 formed on the reverse face side in the view of the dielectric base plate 83. The external conductor 92 is formed, on the dielectric base plate 84, on the four side faces and the bottom face in the drawing except for the formed regions of the signal input, output electrodes (95 and so on). The dielectric filter provided with a coupling electrode layer together with the internal conductor formed holes 85 through 89 is provided in the dielectric interior as shown in FIG. 50 by the layer-building operation of three dielectric base plates 82, 83, 84 shown in FIG. 49.

Figure 51:
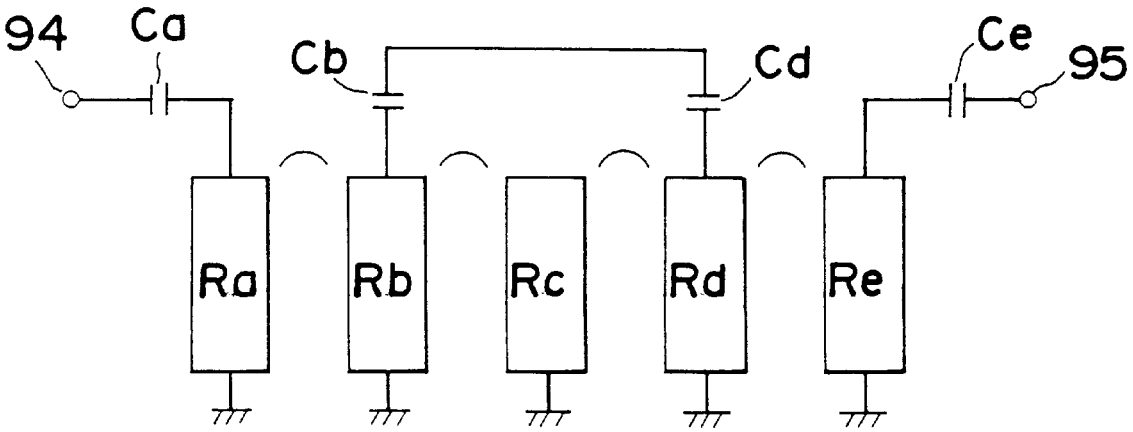
FIG. 51 is an equivalent circuit diagram of a dielectric filter in accordance with the twenty third embodiment.
Figure 52:
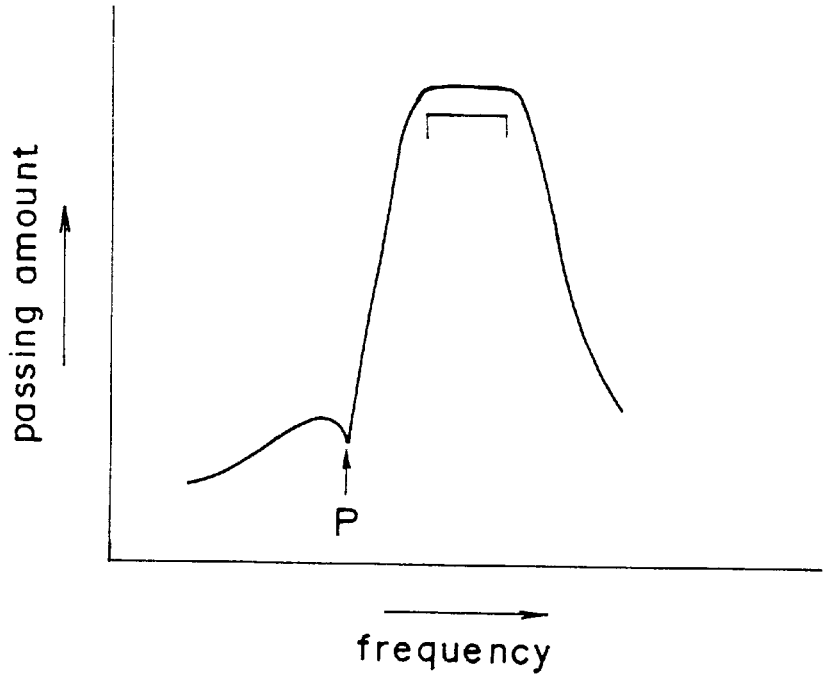
FIG. 52 is a characteristic view of a dielectric filter in accordance with the twenty-third embodiment.

FIG. 51 is an equivalent circuit diagram of a dielectric filter in accordance with the twenty-third embodiment. FIG. 52 shows its characteristics. In FIG. 51, reference characters Ra through Re are resonators formed by the internal conductors 96 through 100 shown in FIG. 49. Reference characters Ca, Ce are capacity to be caused between the internal conductors 96, 100 shown in FIG. 49 and the signal input, output electrodes. Reference characters Cb, Cd are capacity to be caused between the internal conductors 97, 99 shown in FIG. 49 and the coupling electrodes E91, E92. The band passing filter characteristics having a damping pole P on the low-pass side is obtained as shown in FIG. 52 with the capacity connection being effected between the second stage and the fourth stage among five stages.

(Twenty Fourth Embodiment)

Figure 53:
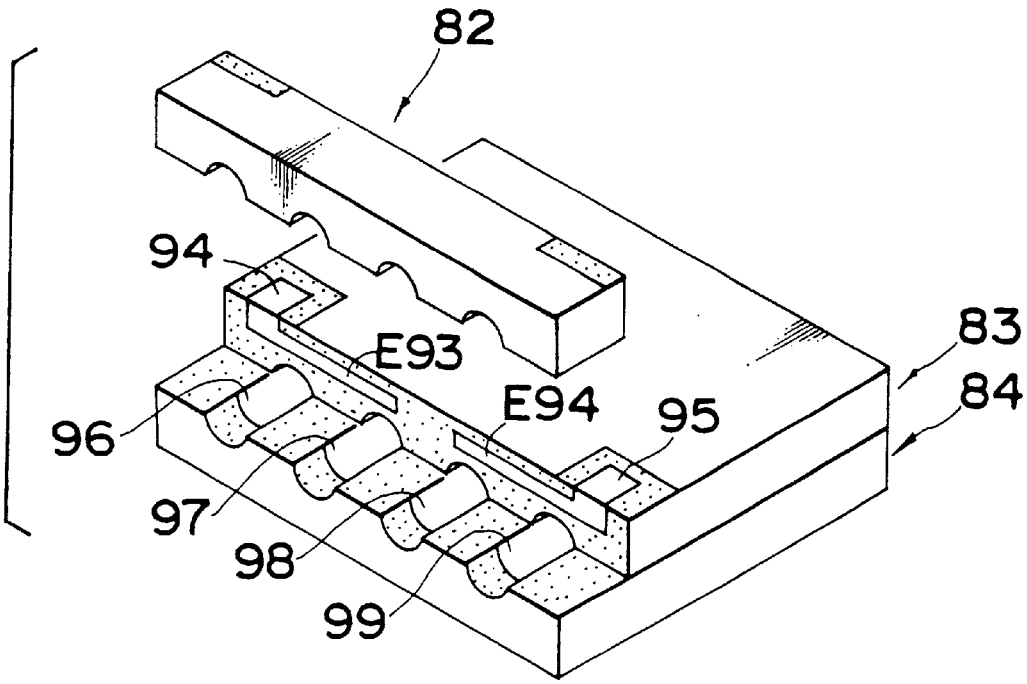
FIG. 53 is an exploded perspective view of a dielectric filter in accordance with a twenty-fourth embodiment.
Figure 54:
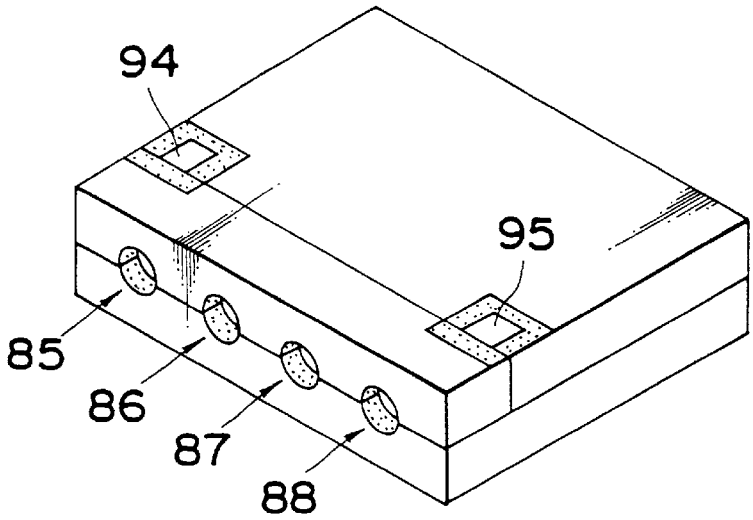
FIG. 54 is a perspective view of a dielectric filter in accordance with the twenty-fourth embodiment.

FIG. 53 is a perspective view before the assembling operation of the dielectric filter in accordance with a twenty fourth embodiment. FIG. 54 is a perspective view after the assembling operation thereof. In FIG. 53, reference numerals 82, 83, 84 are respectively dielectric base plates, grooves are formed respectively on the connection face of the dielectric base plates 83 and 84, and on the connection face between the dielectric base plate 82 and the dielectric base plate 84 so that the internal conductor formed holes 85 through 88 may be formed in an integrated condition as shown in FIG. 54 with these being connected. The internal conductors 96 through 99 are respectively formed on the inside faces thereof. The coupling electrodes E93, E94 are provided on the connection face between the dielectric base plate 82 and the dielectric base plate 83 and are respectively drawn out as the signal input, output electrodes 94, 95 onto the top face in the drawing of the dielectric base plate 83. In such construction, the coupling electrode E93 is connected in capacity with the internal conductors 96, 97, and the coupling electrode E94 is connected in capacity with the internal conductors 98, 99. Therefore, a dielectric filter having a damping pole is obtained on the high-pass side.

A dielectric filter using the dielectric block with a plurality of internal conductor formed holes being formed in it will be shown hereinafter as the twenty fifth through twenty eighth embodiments.

(Twenty Fifth Embodiment)

Figure 55:
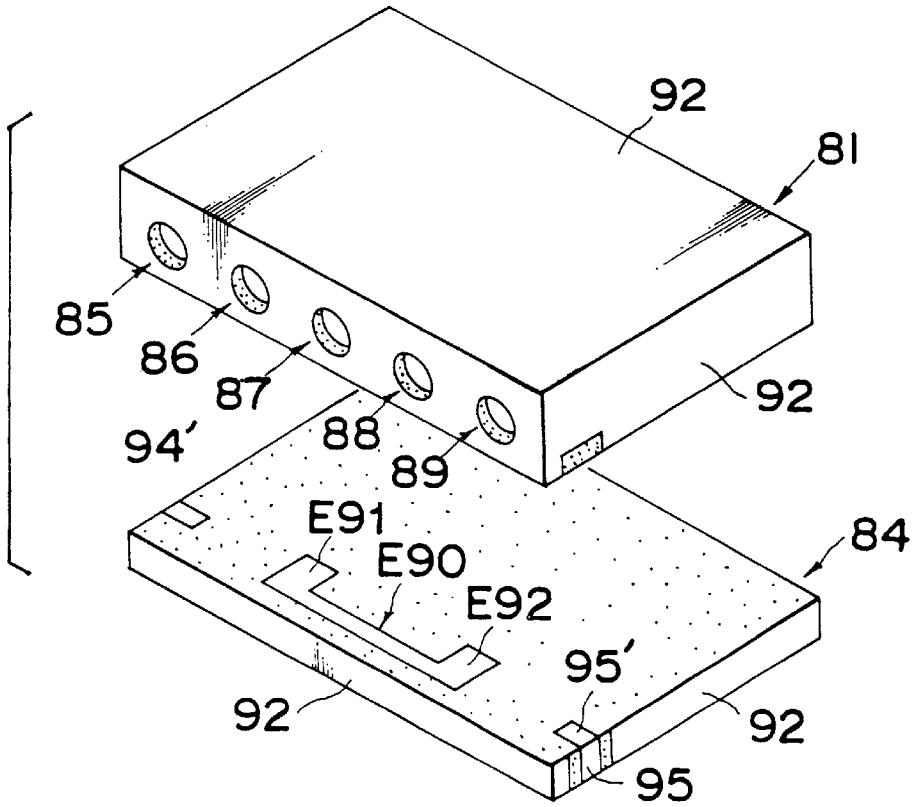
FIG. 55 is an exploded perspective view of a dielectric filter in accordance with a twenty-fifth embodiment.
Figure 56:
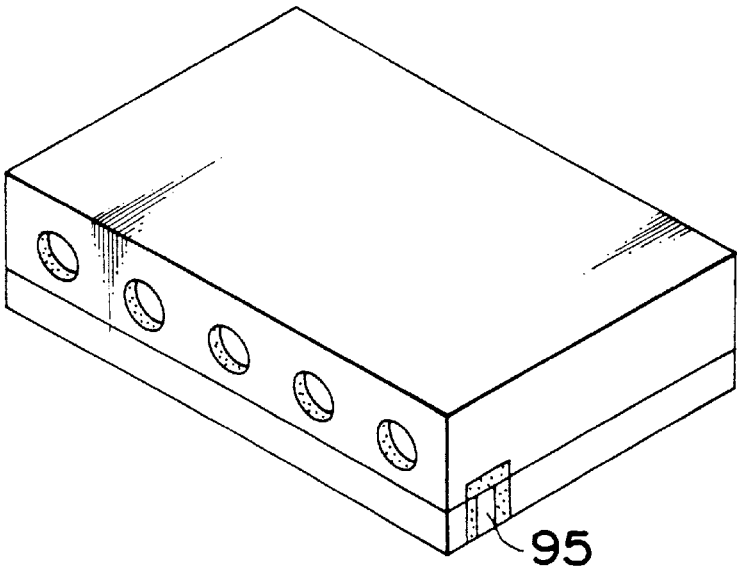
FIG. 56 is a perspective view of a dielectric filter in accordance with the twenty-fifth embodiment.

FIG. 55 is an explosive perspective view of a dielectric filter in accordance with a twenty fifth embodiment. FIG. 56 is a perspective view after the assembling operation thereof. In FIG. 55, reference numeral 81 is a dielectric base plate. Reference numeral 84 is a dielectric base plate. Internal conductor formed holes 85 through 89 are provided in the dielectric block 81, and also, an external conductor 92 is formed on almost all the faces except for the connection face of the dielectric base plate 84. A coupling electrode shown with reference numeral E90 is shown, on the dielectric base plate 84, on the connection face with respect to the dielectric block 81. Portions shown with E91, E92 of the coupling electrode E90 are respectively connected by capacity with the internal conductors within the internal conductor formed holes 86, 88. The electrodes 94', 95' for effecting capacity connection respectively with the internal conductors within the internal conductor formed holes 85, 89 with the connection condition with the dielectric block 81 are provided on the dielectric base plate 84, and these electrodes are drawn out as the signal input, output electrodes on the side of the opposite face (the bottom face in the drawing) through the side face. The dielectric filter shown in FIG. 56 is obtained by the connection between the dielectric block 81 and the dielectric base plate 84. In this case, it functions as a band passing filter having the damping pole on the low-pass side as the second stage is connected by capacity with the fourth stage among the five stages.

(Twenty Sixth Embodiment)

Figure 57:
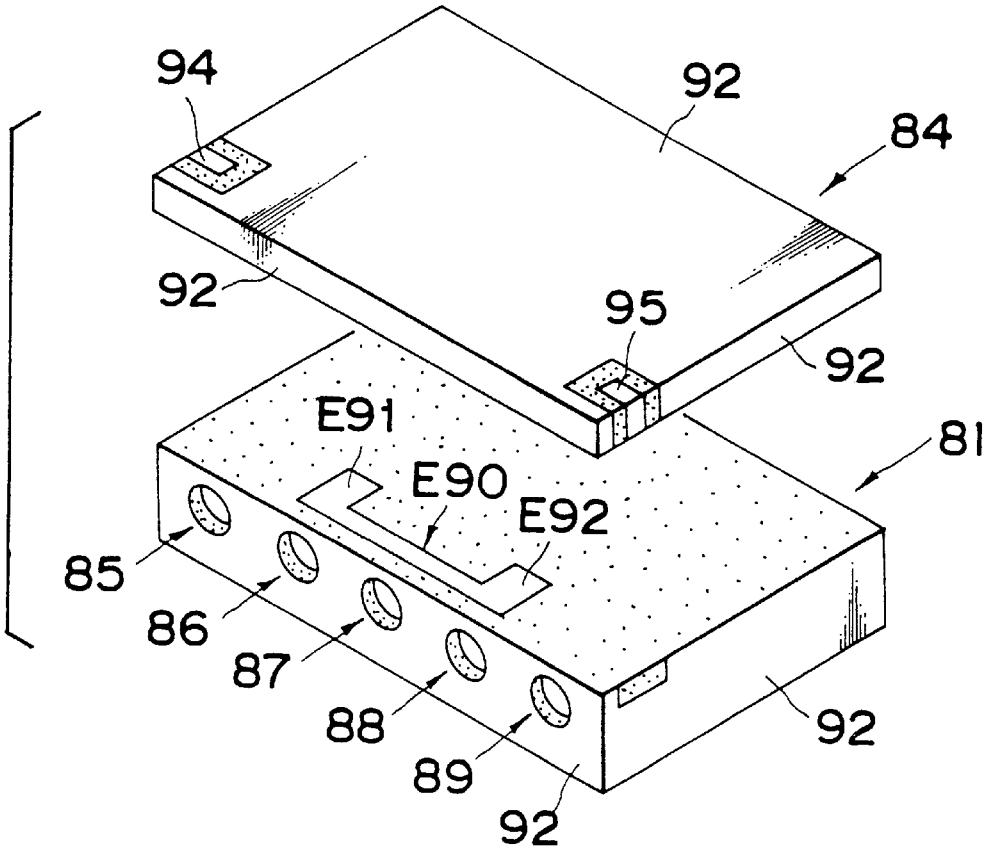
FIG. 57 is an exploded perspective view of a dielectric filter in accordance with a twenty-sixth embodiment.
Figure 58:
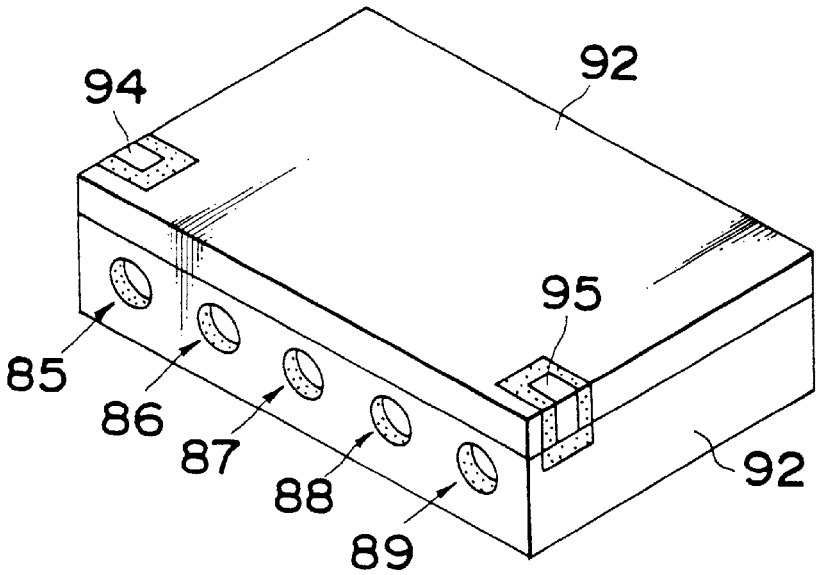
FIG. 58 is a perspective view of a dielectric filter in accordance with the twenty-sixth embodiment.

FIG. 57 is an exploded perspective view before the assembling operation of the dielectric filter in accordance with a twenty sixth embodiment. FIG. 58 is a perspective view after the assembling operation thereof. In FIG. 57, reference numeral 81 is a dielectric block, reference numeral 84 is a dielectric base plate. The different point from the twenty fifth embodiment shown in FIG. 55 and FIG. 56 is that the coupling electrode E90 is provided on the dielectric block 81 side. Even in the case, the coupling electrode E90 is connected by capacity between the internal conductors within the internal conductor formed holes 86, 88 with the dielectric block 81 being connected with the dielectric base plate 84.

(Twenty Seventh Embodiment)

Figure 59:
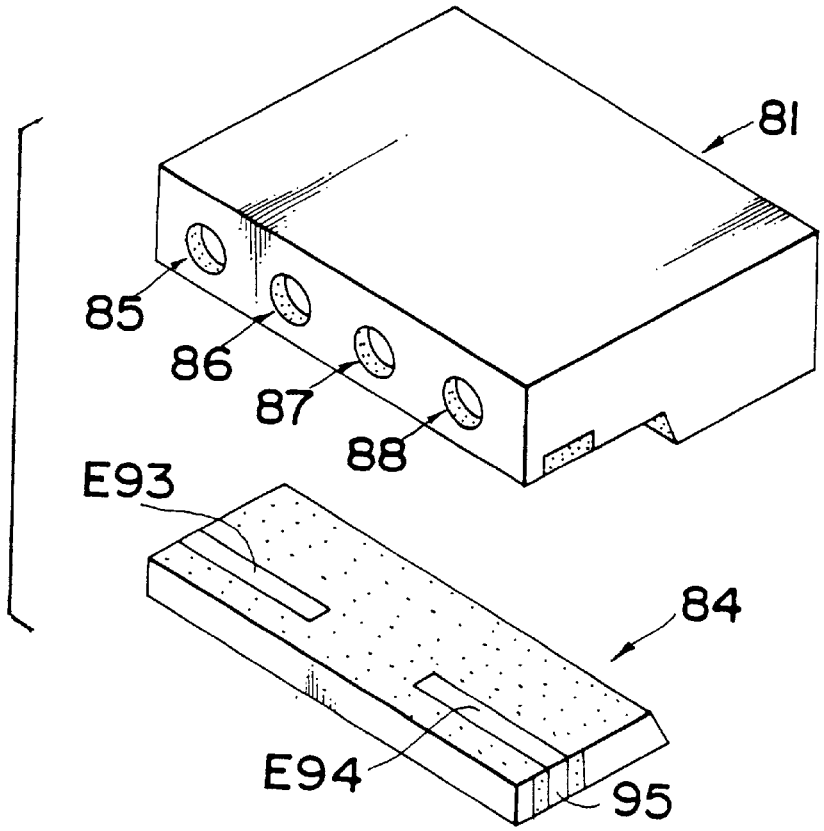
FIG. 59 is an exploded perspective view of a dielectric filter in accordance with a twenty-seventh embodiment.
Figure 60:
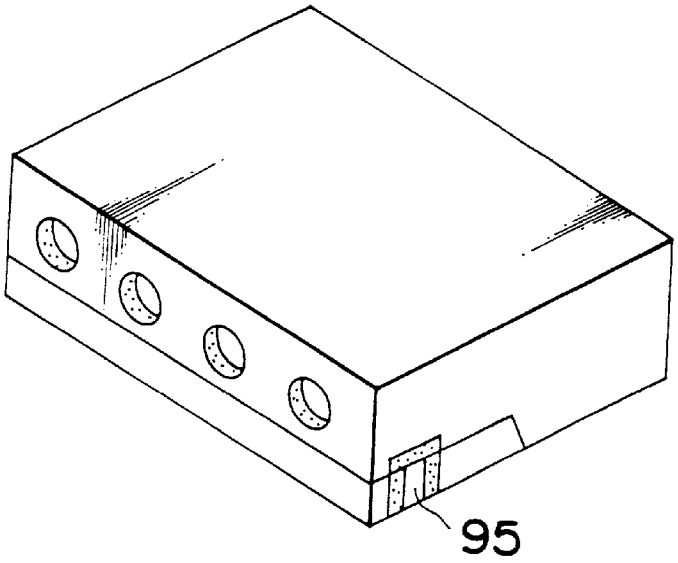
FIG. 60 is a perspective view of a dielectric filter in accordance with the twenty-seventh embodiment.

FIG. 59 is an exploded perspective view before the assembling operation of a dielectric filter in accordance with a twenty seventh embodiment. FIG. 60 is a perspective view after the assembling operation thereof.

In FIG. 59, reference numeral 81 is a dielectric block, reference numeral 84 is a dielectric base plate. Internal conductor formed holes 85 through 88 are provided in the dielectric block 81. On the dielectric base plate 84, the coupling electrodes E93, E94 are formed on the connection face between the dielectric block 81. The coupling electrode E93 effects capacity connection between the internal conductors within the internal conductor formed holes 85, 86 in a connection condition with respect to the dielectric block 81. Reference numeral E94 effects the capacity connection among the internal conductors within the internal conductor formed holes 87, 88. Such a dielectric filter as shown in FIG. 60 is obtained by the connection between the dielectric block 81 and the dielectric base plate 84. As the capacity connection is effected between a first stage and a second stage, and between a third stage and a fourth stage among four stages in this manner, a band passing filter having a pole in the high pass is obtained.

(Twenty Eighth Embodiment)

Figure 61:
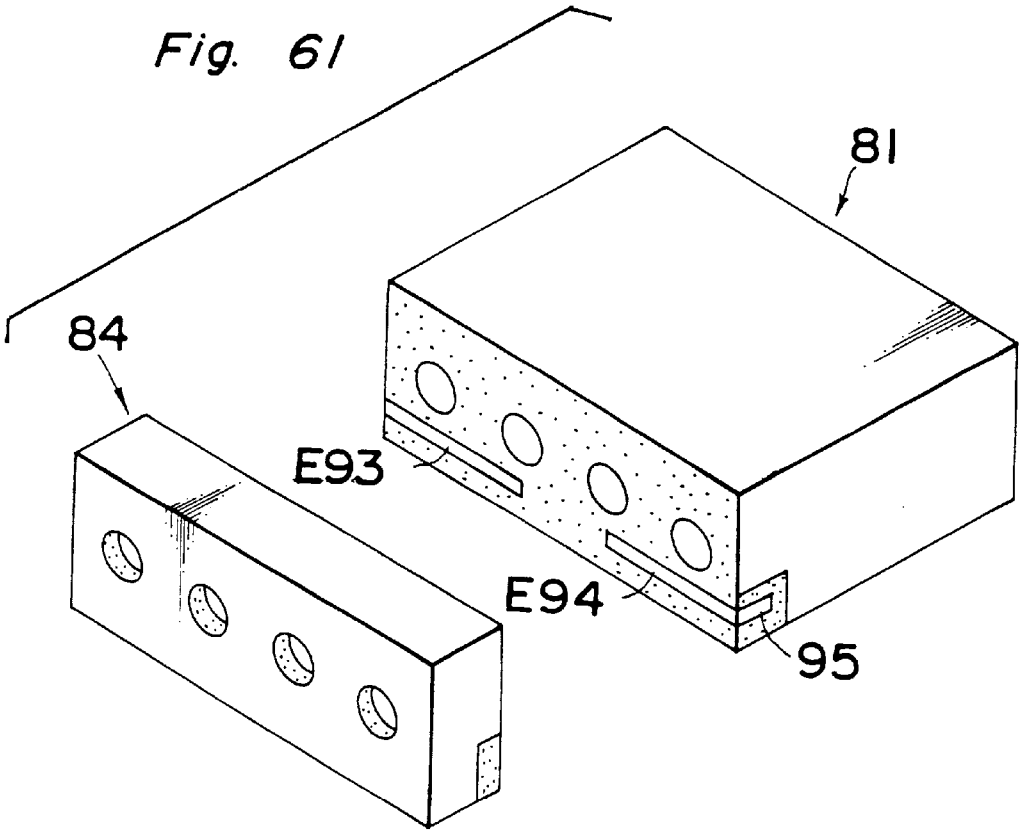
FIG. 61 is an exploded perspective view of a dielectric filter in accordance with a twenty-eighth embodiment.
Figure 62:
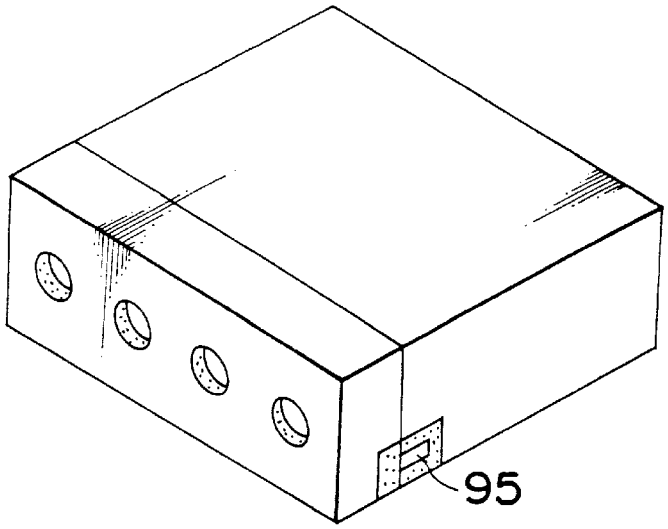
FIG. 62 is a perspective view of a dielectric filter in accordance with the twenty-eighth embodiment.

FIG. 61 is an exploded perspective view before the assembling operation of the dielectric filter in accordance with a twenty eighth embodiment. FIG. 62 is a perspective view after the assembling operation thereof.

In FIG. 61, reference character 81 is a dielectric block, reference numeral 84 is a dielectric base plate. The different portion from the twenty seventh embodiment shown in FIG. 59 and FIG. 60 is that the dielectric base plate 84 is connected in an axial direction with respect to the dielectric block 81. Accordingly, coupling electrodes E93, E94 are formed on the open face side of the dielectric block 81 as shown in FIG. 61. A dielectric filter shown in FIG. 62 is obtained by the connection of the dielectric base plate 84 with the dielectric block 81.

(Twenty Ninth Embodiment)

Figure 63:
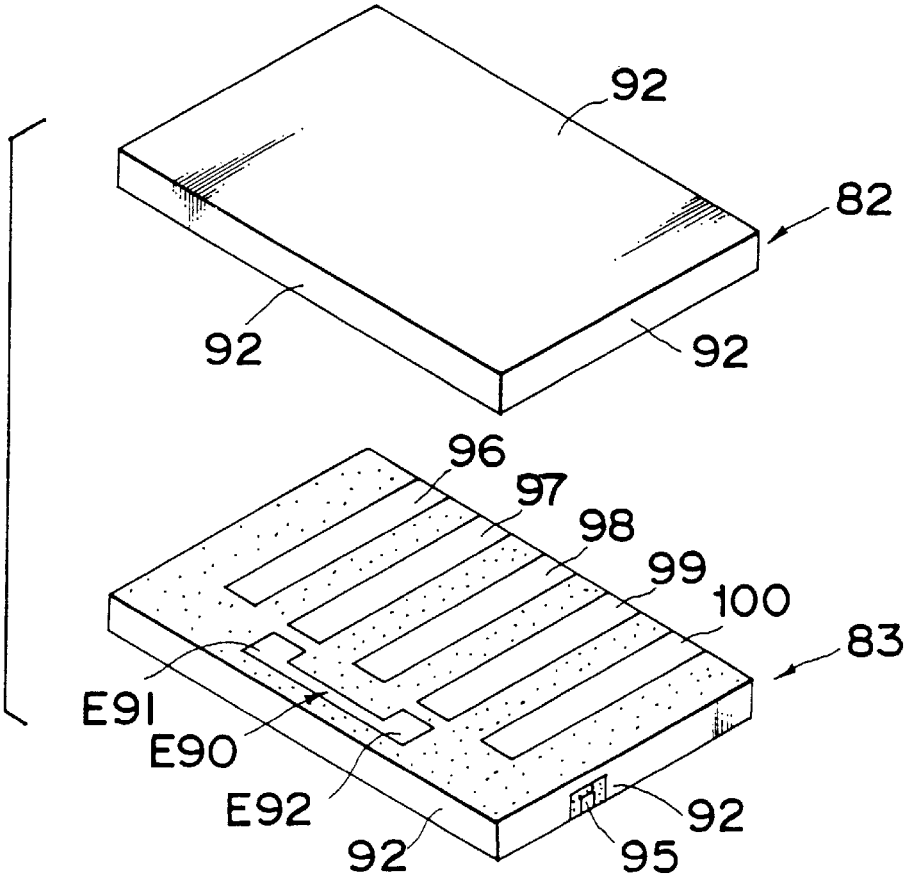
FIG. 63 is an exploded view of a dielectric filter in accordance with a twenty-ninth embodiment.

FIG. 63 is an exploded perspective view of a dielectric filter in accordance with a twenty ninth embodiment. In FIG. 63, reference numerals 82, 83 are respectively dielectric base plates. The earth electrode 92 is formed on five faces except for the connection face with respect to the dielectric base plate 83 is formed on the dielectric base plate 82. On the dielectric base plate 83, the coupling electrode E90 is formed together with five resonance electrodes 96 through 100 are formed on the connection face with the dielectric base plate 82. Also, the earth electrode 92 is formed on the four side faces of the dielectric base plates 83 and the bottom face in the drawing. The portions shown with reference numerals E91, E92 of the coupling electrode E90 are connected by capacity near the open ends of the resonance electrodes 97, 99. A dielectric filter having the damping pole on the low-pass side is obtained by the connection between the dielectric base plates 82, 83 shown in FIG. 63.

(Thirtieth Embodiment)

Figure 64:
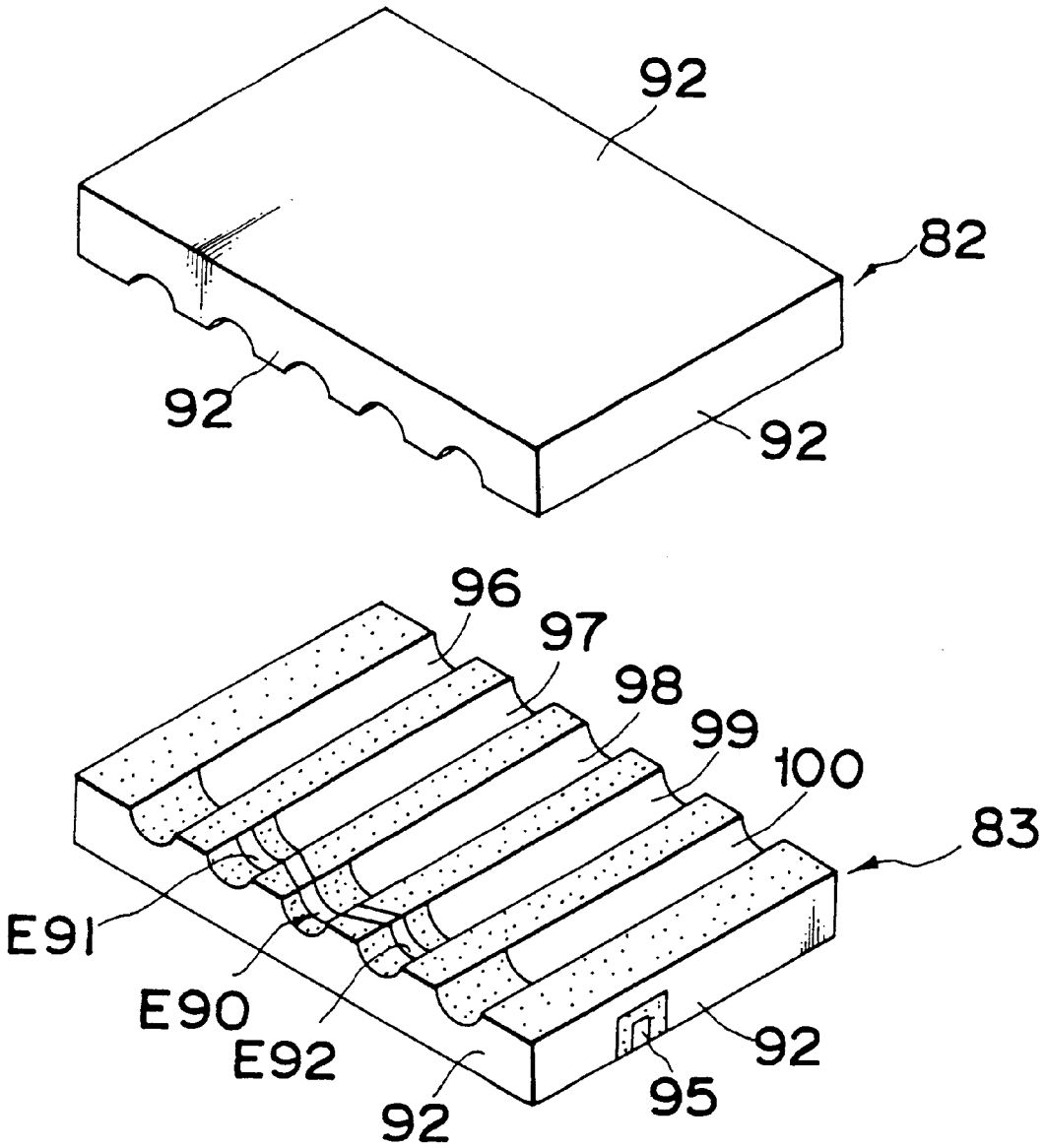
FIG. 64 is an explosive perspective view of a dielectric filter in accordance with a thirtieth embodiment.
Figure 65:
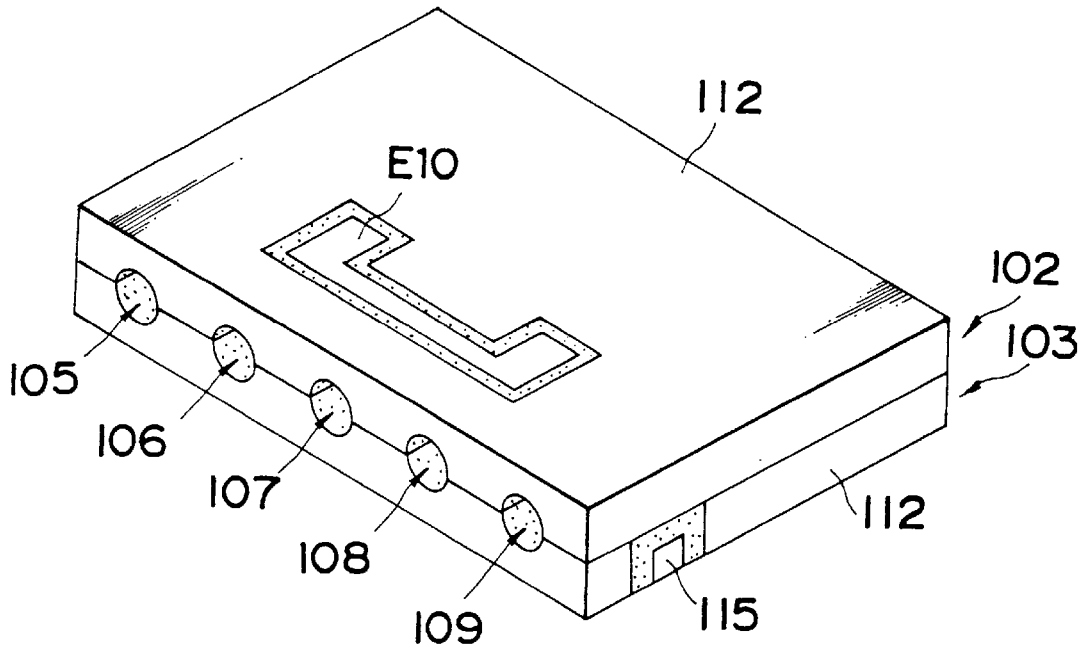
Fig. 65 PRIOR ART
FIG. 65 is a perspective view of a conventional dielectric resonator.
Figure 66:
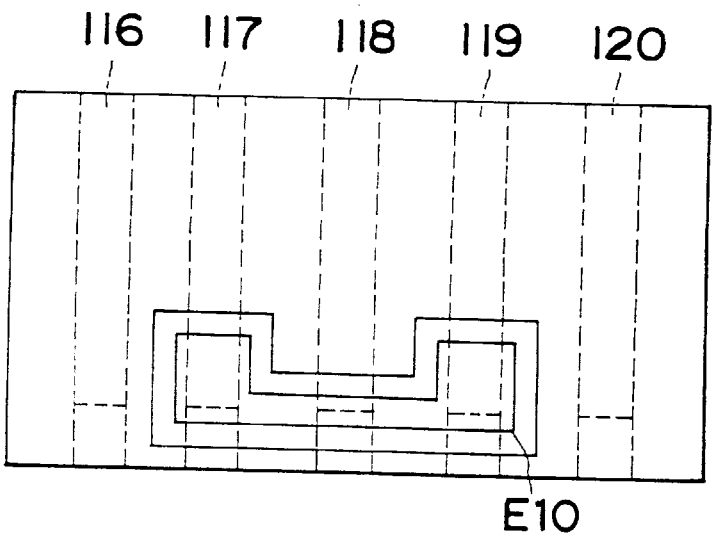
Fig. 66 PRIOR ART
FIG. 66 is a top face view of the dielectric resonator shown in FIG. 65.

FIG. 64 is an exploded perspective view of a dielectric filter in accordance with a thirtieth embodiment. Reference characters 82, 83 are respectively dielectric base plates in FIG. 64. Semi-circular (section) grooves are formed respectively on the connection face of the dielectric base plates 82, 83. An internal conductor shown with reference numerals 96 through 100 is formed on the inside face thereof. An external conductor 92 is formed on the four side faces and the top face in the drawing on the dielectric base plate 82. An external conductor 92 is formed on the four side faces and the top face in the drawing is formed on the dielectric base plate 83. The coupling electrode shown at E10 is formed on the connection face with respect to the dielectric base plate 2 and within the groove on the dielectric base plate 83. The portions shown by E91, E92 of the coupling electrode E90 are connected by capacity with the open end vicinity of the internal conductors 97, 99. The second stage and the fourth stage of the five stages are connected by capacity. The dielectric filter having the damping pole is obtained on the low-pass side by the connection of the dielectric base plates 82, 83.

In accordance with the dielectric resonator and its manufacturing method of the present invention, polarized small sized dielectric resonators can be manufactured with lower price by the sharp reduction of the number of the parts. The Qo of the resonator is not reduced by placing the coupling electrode formed regions as in the prior art in one portion of the earth electrode, so that the band passing filter with less insertion loss can be obtained. As the different filter characteristics can be given by the designing of the coupling electrode layer to be formed within the dielectric, the dielectric filter having optional characteristics different in specification by the combination with respect to the coupling electrode layer can be constructed with the resonator portions being standardized.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as included therein.

What is claimed is:

1. A dielectric filter, comprising a block of dielectric material comprising first and second parts, said parts having respective connection surfaces opposite to each other, said block having an outer surface, two input/output electrodes disposed on the outer surface;

a ground conductor disposed on the outer surface of said block except at locations adjacent to said input/output electrodes, whereby said ground conductor is electrically insulated from said input/output electrodes;

a plurality of resonators provided in said block of dielectric material; and a conductor pattern disposed on the respective connection surface of one of said first and second parts;

said conductor pattern having first portions establishing a capacitive coupling between said first portions and said resonators, respectively; and said connection surface on which said conductor pattern is disposed is laminated against the other of said first and second parts such that said conductor pattern is embedded in said block of dielectric material.

2. The dielectric filter according to claim 1, wherein said input/output electrodes are connected to said conductor pattern.

3. The dielectric filter according to claim 1, wherein said conductor pattern further has second portions establishing a coupling between said first portions.

4. The dielectric filter according to claim 3, wherein said input/output electrodes are connected to said conductor pattern.

5. The dielectric filter according to claim 3, wherein said coupling between said first portions comprises an inductor.

6. The dielectric filter according to claim 5, wherein said input/output electrodes are connected to said conductor pattern.

7. The dielectric filter according to claim 1, wherein the plurality of resonators are formed in respective resonator holes.

8. The dielectric filter according to claim 7, wherein said resonator holes are disposed entirely within said first part of said block, and separated from said conductor pattern by the dielectric material of said first part of said block.

9. The dielectric filter according to claim 8, wherein said conductor pattern is disposed on the second part of said block.

10. The dielectric filter according to claim 9, wherein said input/output electrodes are connected to said conductor pattern.

11. The dielectric filter according to claim 9, wherein said input/output electrodes are disposed on the second part of said block.

12. The dielectric filter according to claim 11, wherein said input/output electrodes are connected to said conductor pattern.

* * * * *

UNITED STATES PATENT AND TRADEMARK OFFICE

CERTIFICATE OF CORRECTION

PATENT NO : 5,949,310

DATED : September 7, 1999

INVENTOR(S) : Haruo MATSUMOTO, et al.

It is certified that error appears in the above identified patent and that said Letters Patent is hereby corrected as shown below.

On the title page: Item [63]

--Continuation of application No. 08/719,335, Sep. 25, 1996, abandoned, which is a continuation of application No. 08/572,154, Dec. 8, 1995, abandoned, which is a continuation of application No. 08/349,461, Dec. 5, 1994, abandoned, which is a continuation of application No. 08/008,903, Jan. 25, 1993, abandoned.--

Signed and Sealed this

Eighteenth Day of July, 2000

*Attest:*

Q. TODD DICKINSON

*Attesting Officer*

*Director of Patents and Trademarks*